US007952538B2

(12) United States Patent
Han et al.

(10) Patent No.: US 7,952,538 B2
(45) Date of Patent: May 31, 2011

(54) PLASMA DISPLAY APPARATUS AND METHOD OF DRIVING THE SAME

(75) Inventors: Jung Gwan Han, Gumi-si (KR); Seongho Kang, Dacgu (KR)

(73) Assignee: LG Electronics Inc., Seoul (KR)

( * ) Notice: Subject to any disclaimer, the term of this patent is extended or adjusted under 35 U.S.C. 154(b) by 1086 days.

(21) Appl. No.: 11/607,856

(22) Filed: Dec. 4, 2006

(65) Prior Publication Data

US 2007/0268212 A1 Nov. 22, 2007

(30) Foreign Application Priority Data

May 16, 2006 (KR) ..... 10-2006-0044007

(51) Int. Cl.
*G09G 3/28* (2006.01)

(52) U.S. Cl. ..... 345/60

(58) Field of Classification Search ..... 345/60–68; 315/169.4

See application file for complete search history.

(56) References Cited

U.S. PATENT DOCUMENTS

| | | | | |
|---|---|---|---|---|
| 5,874,932 | A * | 2/1999 | Nagaoka et al. | 345/60 |
| 6,480,180 | B1 * | 11/2002 | Moon | 345/98 |
| 2001/0013850 | A1 * | 8/2001 | Sakaguchi et al. | 345/87 |
| 2002/0030450 | A1 | 3/2002 | Yoo et al. | 315/169.1 |
| 2002/0154723 | A1 * | 10/2002 | Nakamura | 375/376 |
| 2002/0195970 | A1 | 12/2002 | Lim et al. | 315/169.4 |
| 2004/0008194 | A1 * | 1/2004 | Shigeta et al. | 345/204 |
| 2005/0068266 | A1 | 3/2005 | Sano et al. | 345/60 |
| 2005/0146493 | A1 * | 7/2005 | Kinjo et al. | 345/89 |
| 2005/0286307 | A1 * | 12/2005 | Okutani | 365/185.22 |

FOREIGN PATENT DOCUMENTS

| | | | |
|---|---|---|---|
| CN | 1551064 | A | 12/2004 |
| CN | 1612187 | A | 5/2005 |
| EP | 1 376 526 | A2 | 1/2004 |
| EP | 1 526 501 | A2 | 4/2005 |
| JP | 2004-102259 | | 4/2004 |
| KR | 10-2006-0006669 | A | 1/2006 |
| KR | 10-2006-0126271 | A | 12/2006 |

OTHER PUBLICATIONS

"Open LVDS Interface Specification"; National Semiconductors; May 13, 1991; <URL:http://pagesperso-orange.fr/keetum/opennldi.pdf> (XP 002546352).
European Search Report dated Oct. 7, 2009.

* cited by examiner

*Primary Examiner* — Amr Awad
*Assistant Examiner* — Andre Matthews
(74) *Attorney, Agent, or Firm* — KED & Associates LLP

(57) ABSTRACT

A plasma display apparatus and a method of driving the same are disclosed. The plasma display apparatus includes a plasma display panel including an address electrode, a control board, and a data driver. The control board converts a video signal input from the outside into a differential signal, and transmits the differential signal, wherein the differential signal includes a first signal and a second signal being an inverted signal of the first signal and has a frequency of 200 MHz or more. The data driver receives the differential signal, restores the video signal from the differential signal, and supplies the restored video signal to the address electrode of the plasma display panel.

15 Claims, 19 Drawing Sheets

FIG. 17

| Scan pulse width | Whether address discharge occurs | Whether single scan driving is possible |
|---|---|---|
| 0.4μsec | X | 0 |
| 0.5μsec | X | 0 |
| 0.6μsec | 0 | 0 |
| 0.7μsec | 0 | 0 |
| 0.8μsec | 0 | 0 |
| 0.9μsec | 0 | 0 |
| 1.0μsec | 0 | 0 |
| 1.1μsec | 0 | 0 |
| 1.2μsec | 0 | 0 |
| 1.3μsec | 0 | X |
| 1.4μsec | 0 | X |

PLASMA DISPLAY APPARATUS AND METHOD OF DRIVING THE SAME

This Nonprovisional application claims priority under 35 U.S.C. §119(a) on Patent Application No.10-2006-0044007 filed in Korea on May 16, 2006 the entire contents of which are hereby incorporated by reference.

BACKGROUND

1. Field

This document relates to a display apparatus, and more particularly, to a plasma display apparatus and a method of driving the same.

2. Description of the Related Art

Out of display apparatuses, a plasma display apparatus includes a plasma display panel and a driver for driving the plasma display panel.

The plasma display panel includes a phosphor layer formed inside a discharge cell partitioned by barrier ribs, and a plurality of electrodes, for example, a scan electrode, a sustain electrode, an address electrode.

The driver supplies a driving signal to the discharge cell through the electrodes. Thus, the supplied driving signal generates a discharge within the discharge cell.

When the supplied driving signal generates the discharge within the discharge cell, a discharge gas filled in the discharge cell generates vacuum ultraviolet rays, which thereby cause phosphors formed inside the discharge cell to emit light, thus generating visible light. An image is displayed on the plasma display panel using the visible light.

Examples of the discharge generated inside the discharge cell of the plasma display panel include a reset discharge, an address discharge, and a sustain discharge.

The address discharge is performed to select the discharge cells, that will generate the sustain discharge being a main discharge for displaying the image, among the plurality of discharge cells.

To generate the address discharge, a predetermined video signal of a data signal type is supplied to the address electrode formed in the plasma display panel.

In a related art plasma display apparatus, a relatively strong noise occurs in a video signal (i.e., a data signal) supplied to the address electrode, thereby causing an electrical damage to a circuit of the driver of the related art plasma display apparatus.

Furthermore, the quality of the image achieved by the related art plasma display apparatus worsen, and even the image is not displayed.

A magnitude of the noise generated in the video signal varies with a resistance and the length of a transmission line of the video signal, and the like.

In particular, as the size of the plasma display panel becomes larger, the length of the transmission line of the video signal lengthens. This results in the generation of a more strong noise in the video signal. Accordingly, the electrical damage to the circuit of the driver further increases, and the quality of the displayed image becomes worse.

SUMMARY

In one aspect, a plasma display apparatus comprises a plasma display panel including an address electrode, a control board that converts a video signal input from the outside into a differential signal and transmits the differential signal, wherein the differential signal includes a first signal and a second signal being an inverted signal of the first signal and has a frequency of 200 MHz or more, and a data driver that receives the differential signal, restores the video signal from the differential signal, and supplies the restored video signal to the address electrode of the plasma display panel.

In another aspect, a plasma display apparatus comprises a plasma display panel including an address electrode, a differential signal transmitter that converts a video signal input from the outside into a differential signal and transmits the differential signal, wherein the differential signal includes a first signal and a second signal being an inverted signal of the first signal and has a frequency of 200 MHz or more, a differential signal receiver that receives the differential signal and restores the video signal from the differential signal, and a data drive integrated circuit unit that supplies the restored video signal to the address electrode of the plasma display panel.

In still another aspect, a method of driving a plasma display apparatus, comprises converting a video signal input from the outside into a differential signal having a frequency of 200 MHz or more, and transmitting the differential signal, receiving the differential signal, restoring the video signal from the differential signal, and supplying the recovered video signal to a plasma display panel, supplying a reset pulse to a scan electrode of the plasma display panel during a reset period, and supplying a scan pulse to the scan electrode during an address period, wherein the width of the scan pulse substantially ranges from 0.6 μm to 1.2 μm.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention.

FIG. 17 illustrates a discharge characteristic depending on a change in the width of a scan signal of a driving waveform generated in the plasma display apparatus according to the embodiment.

DETAILED DESCRIPTION OF PREFERRED EMBODIMENTS

Figure 1:
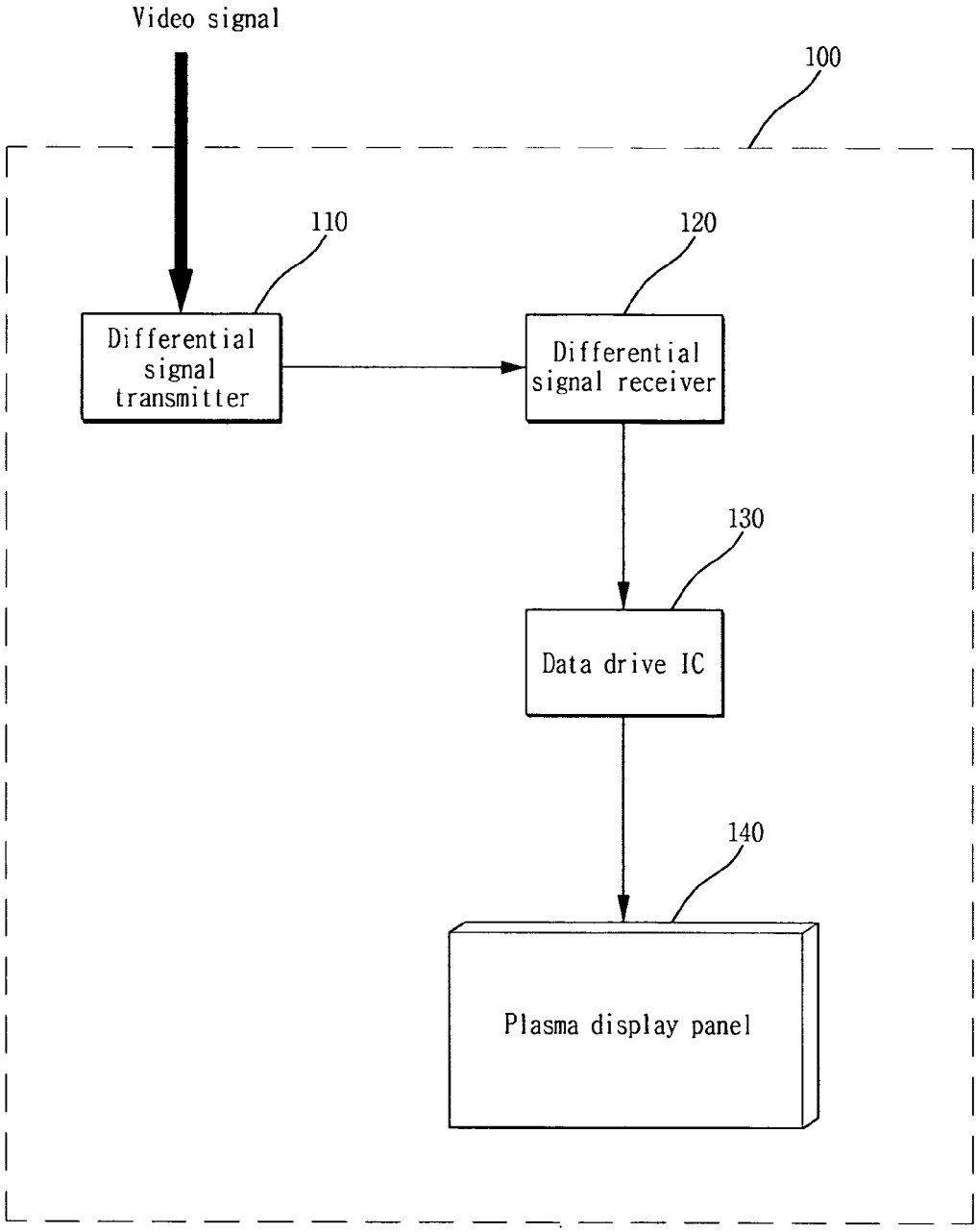
FIG. 1 illustrates the configuration of a plasma display apparatus according to an embodiment.

Reference will now be made in detail embodiments of the invention examples of which are illustrated in the accompanying drawings.

A plasma display apparatus comprises a plasma display panel including an address electrode, a control board that converts a video signal input from the outside into a differential signal and transmits the differential signal, wherein the differential signal includes a first signal and a second signal being an inverted signal of the first signal and has a frequency of 200 MHz or more, and a data driver that receives the differential signal, restores the video signal from the differential signal, and supplies the restored video signal to the address electrode of the plasma display panel.

The control board may include a differential signal transmitter that converts the video signal into the differential signal and transmits the differential signal. The data driver may include a differential signal receiver that receives the differential signal and restores the video signal from the differential signal, and a data drive integrated circuit that supplies the restored video signal by the differential signal receiver to the address electrode of the plasma display panel through a switching operation.

The differential signal may include a differential data signal and a differential clock signal for controlling the transmission of the differential data signal, and the differential clock signal may substantially have a frequency of 200 MHz.

The differential signal may include a differential data signal and a differential clock signal for controlling the transmission of the differential data signal, and the differential clock signal may substantially have a frequency of 400 MHz.

A voltage level difference between the first signal and the second signal may substantially range from 0.1V to 0.5V.

The differential signal receiver may include a first differential signal receiver and a second differential signal receiver. The first differential signal receiver and the second differential signal receiver may commonly use the differential clock signal.

A plasma display apparatus comprises a plasma display panel including an address electrode, a differential signal transmitter that converts a video signal input from the outside into a differential signal and transmits the differential signal, wherein the differential signal includes a first signal and a second signal being an inverted signal of the first signal and has a frequency of 200 MHz or more, a differential signal receiver that receives the differential signal and restores the video signal from the differential signal, and a data drive integrated circuit unit that supplies the restored video signal to the address electrode of the plasma display panel.

The differential signal receiver and the data drive integrated circuit may be commonly disposed on a flexible substrate, and at least one data drive integrated circuit may be disposed on the flexible substrate.

The differential signal receiver and the data drive integrated circuit may be integrated with each other in the form of one chip.

A voltage level difference between the first signal and the second signal may substantially range from 0.1V to 0.5V.

The differential signal transmitter may be formed on a control board for controlling the driving of the plasma display panel.

The differential signal may include a differential data signal and a differential clock signal for controlling the transmission of the differential data signal, and the differential clock signal may substantially have a frequency of 200 MHz.

The differential signal receiver may include a first differential signal receiver and a second differential signal receiver, and the first differential signal receiver and the second differential signal receiver may commonly use the differential clock signal.

The differential signal may include a differential data signal and a differential clock signal for controlling the transmission of the differential data signal, and the differential clock signal may substantially have a frequency of 400 MHz.

The differential signal transmitter may transmit a main clock signal, a strobe signal, a high blanking signal, and a low blanking signal to the differential signal receiver. The differential signal receiver may transmit the main clock signal, the strobe signal, the high blanking signal, and the low blanking signal to the data drive integrated circuit. The main clock signal may be a clock signal for an operation of the data drive integrated circuit, and substantially have a frequency of 50 MHz.

A method of driving a plasma display apparatus, comprises converting a video signal input from the outside into a differential signal having a frequency of 200 MHz or more, and transmitting the differential signal, receiving the differential signal, restoring the video signal from the differential signal, and supplying the recovered video signal to a plasma display panel, supplying a reset pulse to a scan electrode of the plasma display panel during a reset period, and supplying a scan pulse to the scan electrode during an address period, wherein the width of the scan pulse substantially ranges from 0.6 μm to 1.2 μm.

The differential signal may include a differential data signal and a differential clock signal for controlling the transmission of the differential data signal, and the differential clock signal may substantially have a frequency of 200 MHz.

The differential signal may include a differential data signal and a differential clock signal for controlling the transmission of the differential data signal, and the differential clock signal substantially may have a frequency of 400 MHz.

Hereinafter, exemplary embodiments will be described in detail with reference to the attached drawings.

FIG. 1 illustrates the configuration of a plasma display apparatus according to an embodiment.

Referring to FIG. 1, a plasma display apparatus 100 according to an embodiment includes a differential signal transmitter 110, a differential signal receiver 120, a data drive integrated circuit (IC) 130, and a plasma display panel 140.

The differential signal transmitter 110 converts a video signal input from the outside into a differential signal, and then transmits the differential signal to the differential signal receiver 120. The differential signal includes a first signal and a second signal being an inverted signal of the first signal, and has a frequency of 200 MHz or more.

The differential signal receiver 120 receives the differential signal from the differential signal transmitter 110, and restores the video signal.

The data drive IC 130 supplies the restored video signal to an address electrode of the plasma display panel 140 through a switching operation.

The plasma display panel 140 includes the address electrode to which the video signal, i.e., a data signal will be supplied. An image is displayed on the plasma display panel 140 in response to a video signal supplied to the address electrode.

Figure 2A:
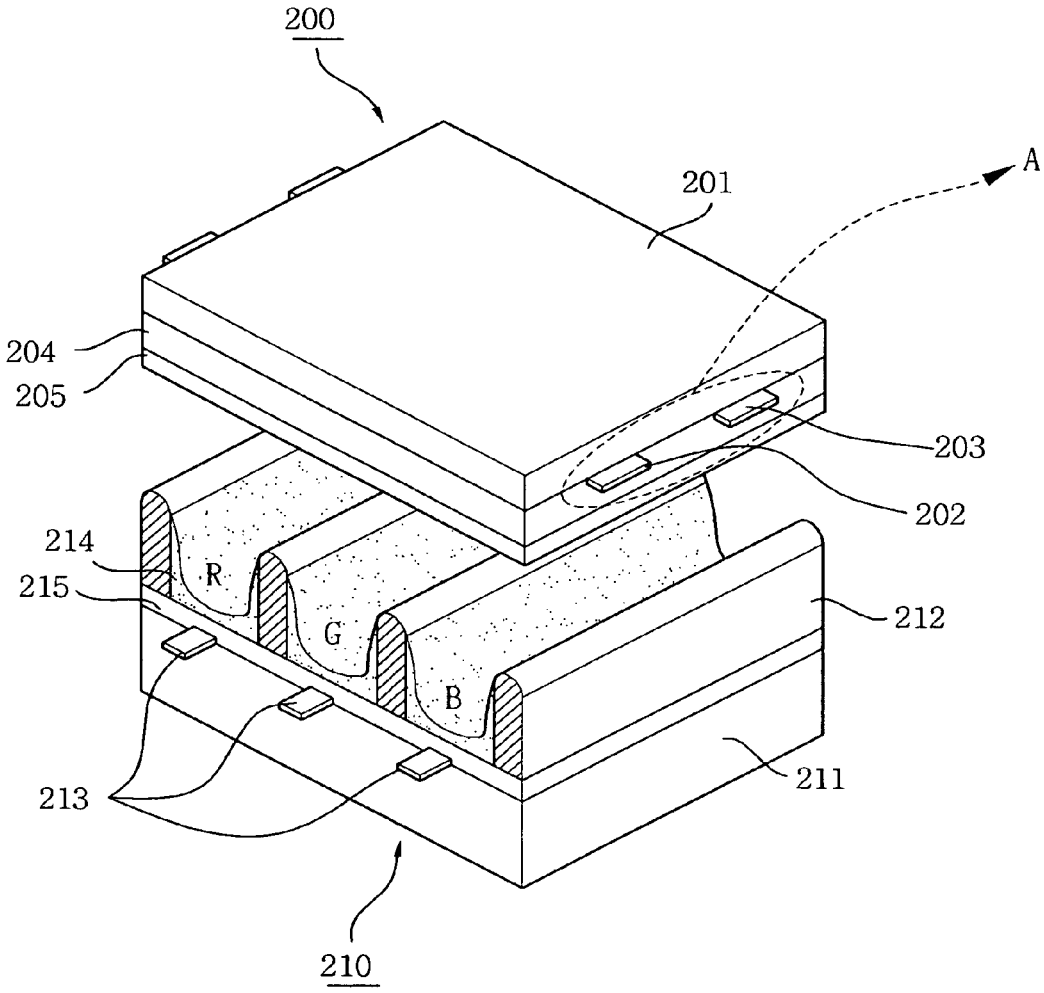
FIGS. 2*a* and 2*b* illustrate an example of the structure of a plasma display panel of the plasma display apparatus according to the embodiment.
Figure 2B:
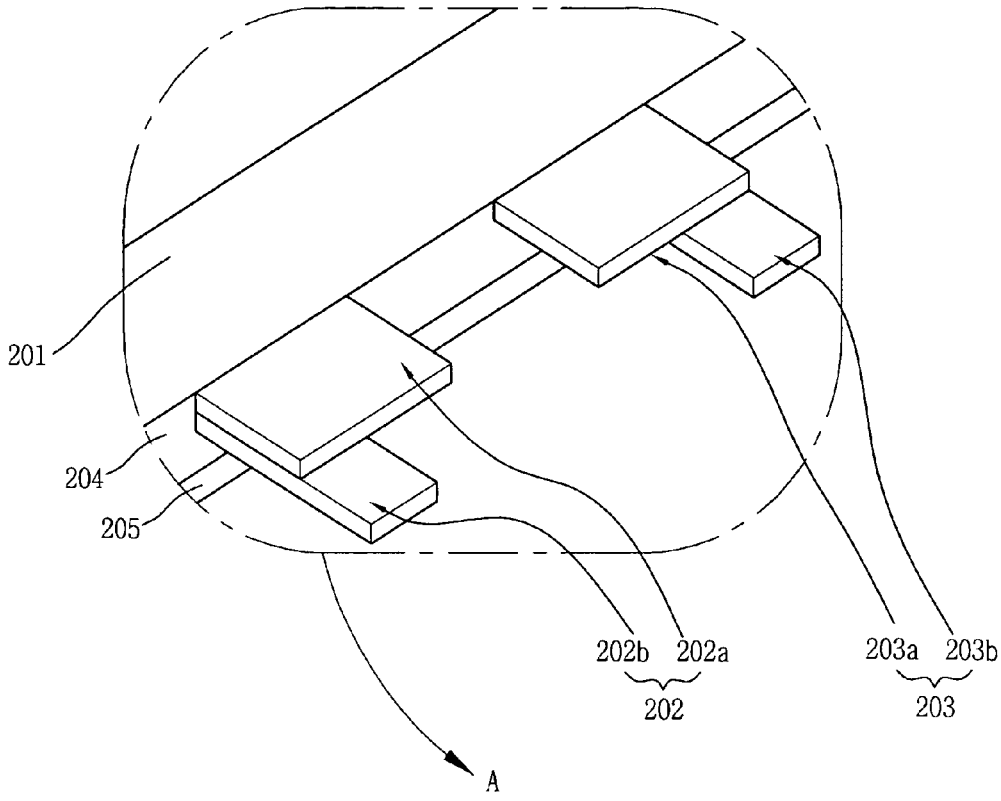

An example of the plasma display panel 140 applicable to the plasma display apparatus 100 according to the embodiment is illustrated in FIGS. 2*a* and 2*b*.

FIGS. 2*a* and 2*b* illustrate an example of the structure of a plasma display panel of the plasma display apparatus according to the embodiment.

Referring to FIG. 2*a*, the plasma display panel includes a front panel 200 and a rear panel 210 which are coupled with each other. The front panel 200 includes a front substrate 201 on which a scan electrode 202 and a sustain electrode 203 are formed. The rear panel 210 includes a rear substrate 211 on which an address electrode 213 is formed.

The scan electrode 202 and the sustain electrode 203 formed on the front substrate 201 generate a discharge in a discharge space, i.e., a discharge cell, and maintain the discharge of the discharge cell.

On an upper portion of the front substrate 201 on which the scan electrode 202 and the sustain electrode 203 are formed, an upper dielectric layers 204 for covering the scan electrode 202 and the sustain electrode 203 is formed.

The upper dielectric layers 204 limits a discharge current of the scan electrode 202 and the sustain electrode 203, and provides insulation between the scan electrode 202 and the sustain electrode 203.

A protective layer 205 is formed on an upper surface of the upper dielectric layer 204 to facilitate discharge conditions. The protective layer 205 is formed by depositing a material such as magnesium oxide (MgO) on an upper portion of the upper dielectric layer 204.

The address electrode 213 formed on the rear substrate 211 is used to supply a data signal to the discharge cell.

On an upper portion of the rear substrate 211 on which the address electrode 213 is formed, a lower dielectric layer 215 for covering the address electrode 213 is formed.

The lower dielectric layer 215 provides insulation between the address electrodes 213.

A stripe-type or well-type barrier ribs 212 for partitioning the discharge cell are formed on an upper portion of the lower dielectric layer 215.

Accordingly, Red (R), green (G), and blue (B) discharge cells are formed between the front substrate 201 and the rear substrate 211.

Each of the discharge cells partitioned by the barrier ribs 212 is filled with a predetermined discharge gas.

A phosphor layer 214 for emitting visible light for an image display when generating an address discharge is formed in each of the discharge cells partitioned by the barrier ribs 212. For example, Red (R), green (G), and blue (B) phosphor layers may be formed.

As above, in the plasma display panel according to the embodiment, a driving signal is supplied to at least one of the scan electrode 202, the sustain electrode 203 or the address electrode 213 such that a discharge occurs within the discharge cells partitioned by the barrier ribs 212.

Thus, the discharge gas filled in the discharge cell generates vacuum ultraviolet rays, and the vacuum ultraviolet rays are applied to the phosphor layer 214 formed within the discharge cell, thereby generating visible light in the phosphor layer 214. The visible light thus generated is emitted to the outside through the front substrate 201 on which the upper dielectric layer 204 is formed, thus displaying a predetermined image on an outside surface of the front substrate 201.

Although FIG. 2*a* has illustrated and described a case where the scan electrode 202 and the sustain electrode 203 are formed in the form of one layer, the scan electrode 202 and the sustain electrode 203 may be formed of a plurality of layers. This will be described in detail with reference to FIG. 2*b*.

Referring to FIG. 2*b*, the scan electrode 202 and the sustain electrode 203 each may be formed of two layers.

Light transmissivity and electrical conductivity of the scan electrode 202 and the sustain electrode 203 need to be considered to emit light generated within the discharge cell to the outside and to secure driving efficiency. Accordingly, it is preferable that the scan electrode 202 and the sustain electrode 203 each include transparent electrodes 202*a* and 203*a* made of transparent indium-tin-oxide (ITO) material and bus electrodes 202*b* and 203*b* made of opaque Ag.

Since the scan electrode 202 and the sustain electrode 203 each include the transparent electrodes 202*a* and 203*a*, the visible light generated in the discharge cell is efficiently emitted to the outside of the plasma display panel.

Since the scan electrode 202 and the sustain electrode 203 each include the bus electrodes 202*b* and 203*b*, the bus electrodes 202*b* and 203*b* prevent a reduction in the driving efficiency caused by the transparent electrodes 202*a* and 203*a* with low electrical conductivity. In other words, the bus electrodes 202*b* and 203*b* compensate the low electrical conductivity of the transparent electrodes 202*a* and 203*a* capable of causing the reduction in the driving efficiency.

Only an example of the plasma display panel applicable to the embodiment has been illustrated in FIGS. 2*a* and 2*b*. However, the embodiment is not limited to the structure of the plasma display panel illustrated in FIGS. 2*a* and 2*b*.

For example, although FIGS. 2*a* and 2*b* have illustrated and described a case where the upper dielectric layer 204 and the lower dielectric layer 215 are formed in the form of one layer, at least one of the upper dielectric layer 204 and the lower dielectric layer 215 may be formed of a plurality of layers.

Further, although FIGS. 2*a* and 2*b* have illustrated and described a case where the plasma display panel includes the scan electrode 202, the sustain electrode 203, and the address electrode 213, at least one of the scan electrode 202, the sustain electrode 203, and the address electrode 213 may be omitted in the plasma display panel applicable to the plasma display apparatus according to the embodiment.

Further, FIGS. 2*a* and 2*b* have illustrated and described a case where the front panel 200 includes the scan electrode 202 and the sustain electrode 203 and the rear panel 210 includes the address electrode 213. However, the front panel 200 may include the scan electrode 202, the sustain electrode 203, and the address electrode 213, or at least one of the scan electrode 202, the sustain electrode 203, and the address electrode 213 may be formed on the barrier rib 212.

The structure of the plasma display panel applicable to the plasma display apparatus according to the embodiment may vary.

The description of FIGS. 2*a* and 2*b* is completed, and the description of FIG. 1 is continued.

Referring to an operation of the plasma display apparatus of FIG. 1, when a video signal is input from the outside, the differential signal transmitter 110 converts the input video signal into a differential signal, and then transmits the differential signal to the differential signal receiver 120.

Next, the differential signal receiver 120 receives the differential signal from the differential signal transmitter 110. Then, the differential signal receiver 120 restores the video signal from the received differential signal in a state before converting the differential signal.

The data drive IC 130 supplies the restored video signal to the address electrode of the plasma display panel 140 through a predetermined switching operation.

FIG. 1 has illustrated and described the conversion of the input video signal into the differential signal and the transmitting and receiving processes of the differential signal. However, before converting the input video signal into the differential signal, various image processing such as an inverse gamma correction process, a gain control process may be added. The various image processing will be described with reference to FIG. 3.

Figure 3:
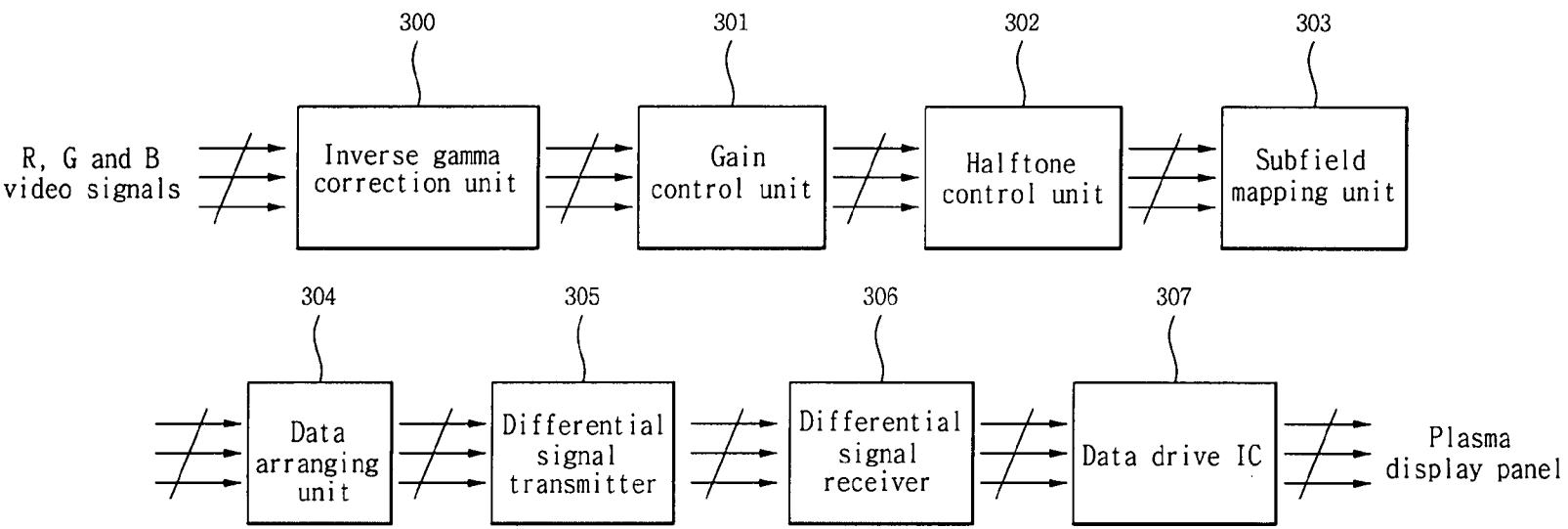
FIG. 3 illustrates image processing in the plasma display apparatus according to the embodiment.

FIG. 3 illustrates image processing in the plasma display apparatus according to the embodiment.

Referring to FIG. 3, the plasma display apparatus according to the embodiment further includes an inverse gamma correction unit 300, a gain control unit 301, a halftone control unit 302, a subfield mapping unit 303, and a data arranging unit 304.

The inverse gamma correction unit 300 performs an inverse gamma correction process on a video signal (for example, a red (R) video signal, a green (G) video signal, a blue (B) video signal) input from the outside, for example, a video signal controller.

The gain control unit 301 controls a data level of the inverse-gamma corrected video signal by the inverse gamma correction unit 300.

The halftone control unit 302 performs an error diffusion process or a dithering process on the video signal with the controlled data level, thereby improving the representation ability of gray level.

The subfield mapping unit 303 performs a subfield mapping process on the halftone controlled video signal by the halftone control unit 302.

The data arranging unit 304 rearranges the subfield-mapped video signal for each subfield.

A differential signal transmitter 305 converts the video signal, which is processed through the above-described processes, into a differential signal, and then transmits the differential signal to a differential signal receiver 306.

Preferably, the differential signal transmitter 305 converts the video signal into at least one of a low voltage differential signal (LVDS), a bus low voltage differential signal (BLVDS), a multipoint low voltage differential signal (MLVDS), a mini low voltage differential signal, and a reduced swing differential signal (RSDS). Then, the differential signal transmitter 305 transmits the converted signal to the differential signal receiver 306.

In other words, the differential signal transmitter 305 converts the video signal rearranged for each subfield into the differential signal, and then transmits the differential signal to the differential signal receiver 306. Preferably, the differential signal transmitter 305 converts the video signal into a differential signal including a first signal and a second signal being an inverted signal of the first signal, and then transmits the differential signal to the differential signal receiver 306.

The differential signal receiver 306 receives the low voltage differential signal from the differential signal transmitter 305, and then restores the video signal using a difference between voltage levels of the first signal and the second signal of the low voltage differential signal.

More specifically, the differential signal receiver 306 senses the voltage difference between the first signal and the second signal being the inverted signal of the first signal. Then, the differential signal receiver 306 restores the original video signal which is subfield mapped and rearranged for each address electrode. The differential signal receiver 306 supplies the restored video signal to a data drive IC 307.

The data drive IC 307 supplies the restored video signal in the form of data pulse to the address electrode of the plasma display panel through a predetermined switching operation.

The data drive IC 307 includes a plurality of channels connected to the address electrodes.

In particular, it is preferable that the number of channels for each data drive IC 307 is 256 or more. For example, one data drive IC 307 includes 256 channels.

As above, when one data drive IC 307 includes 256 or more channels, the total number of data drive IC 307 used in one plasma display apparatus is reduced. Thus, the manufacturing cost of the plasma display apparatus is reduced.

Operations of the differential signal transmitter 305 and the differential signal receiver 306 will be described with reference to FIG. 4.

Figure 4:
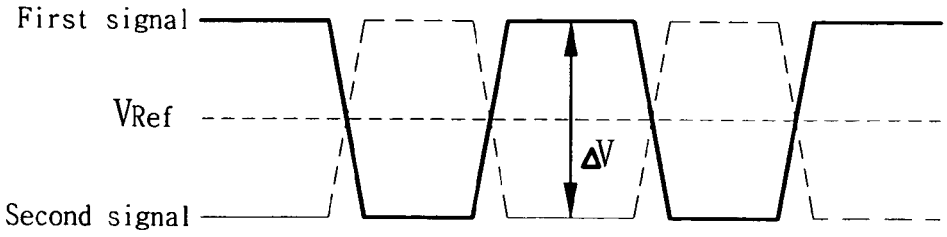
FIG. 4 illustrates operations of a differential signal transmitter and a differential signal receiver in the plasma display apparatus according to the embodiment.

FIG. 4 illustrates operations of a differential signal transmitter and a differential signal receiver in the plasma display apparatus according to the embodiment.

More specifically, FIG. 4 illustrates an example of the structure of the differential signal converted by the differential signal transmitter 305.

The differential signal includes the first signal having a predetermined swing width based on a reference voltage $V_{Ref}$, and the second signal being an inverted signal of the first signal.

There is a predetermined voltage difference ($\Delta V$) between the first signal and the second signal. The predetermined voltage difference ($\Delta V$) between the first signal and the second signal may vary with a type of the differential signal.

For example, a voltage difference between a first signal and a second signal in each of a low voltage differential signal, a mini low voltage differential signal, and a reduced swing differential signal may be different from one another.

For example, a voltage difference between a first signal and a second signal in the low voltage differential signal may be set to about 350 mV, and a voltage difference between a first signal and a second signal in the mini low voltage differential signal may be set to about 200 mV.

In a case where the voltage level difference between the first signal and the second signal is excessively large, a swing width of the voltage level difference between the first signal and the second signal excessively increases. This results in an increase in power consumption when transmitting and receiving the first signal and the second signal.

On the other hand, in a case where the voltage level difference between the first signal and the second signal is excessively small, the first signal and the second signal may be weak to a noise. Considering this, it is preferable that the voltage level difference between the first signal and the second signal ranges from 0.1V to 0.5V.

When the differential signal transmitter 305 transmits the differential signal including the first signal and the second signal to the differential signal receiver 306, the differential signal receiver 306 receives the differential signal, and then restores the original video signal using a voltage level difference between the first signal and the second signal of the received differential signal.

Figure 5A:
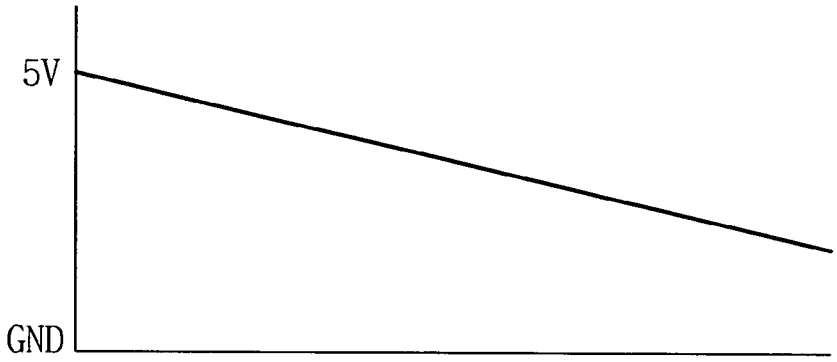
FIGS. 5*a* and 5*b* illustrate transmitting and receiving characteristics of a differential signal in the plasma display apparatus according to the embodiment.
Figure 5B:
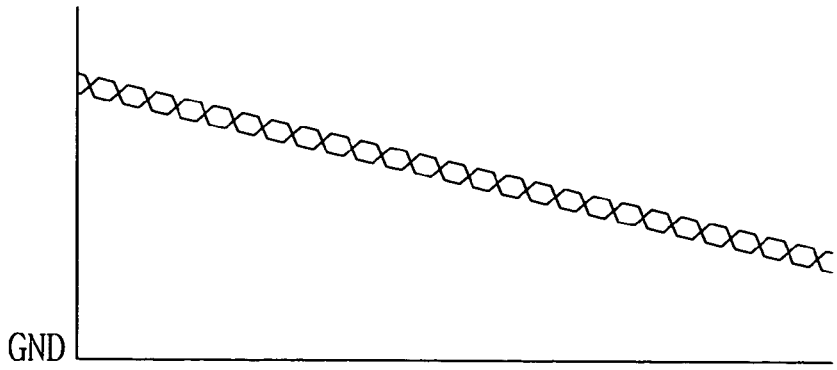

FIGS. 5*a* and 5*b* illustrate transmitting and receiving characteristics of a differential signal in the plasma display apparatus according to the embodiment.

FIG. 5*a* illustrates a pattern of transmitted and received video data in the related art plasma display apparatus.

In FIG. 5*a*, the transmission of a video signal of about 5V to a data drive IC in the related art plasma display apparatus is illustrated. As a transmission path of the video signal lengthens, a resistance of the video signal increases. Thus, a voltage drop of the video signal further increases. After all, the original video signal may be different from the video signal reaching the data drive IC.

Accordingly, a magnitude of the video signal supplied to the address electrode of the plasma display panel decreases such that a discharge occurs unstably. Further, the quality of an image displayed on the plasma display panel worsens, and even a wanted image is not displayed.

On the other hand, FIG. 5*b* illustrates the transmission of the video signal in the form of a pair of differential signals transmitted by the differential signal transmitter of the plasma display apparatus according to the embodiment.

For example, the differential signal transmitter transmits the differential signal to the differential signal receiver in a state in which there is a predetermine voltage level difference between the first signal and the second signal of the differential signal. Voltage levels of the pair of differential signals may vary with a resistance, and the like. However, the voltage level difference between the first signal and the second signal of the differential signal is maintained constant.

For example, when a noise occurs in the pair of differential signals, the noise occurs in both the first signal and the second signal. However, there is little change in the voltage level difference between the first signal and the second signal.

Accordingly, when the video signal is supplied to the address electrode of the plasma display panel through the differential signal transmitter and the differential signal receiver, the voltage level difference between the first signal and the second signal is maintained constant such that the video signal is transmitted stably.

Further, an influence of electromagnetic interference (EMI) and a noise on the video signal is minimized. After all, although a voltage drop occurs by a resistance on the transmission path of the video signal, a voltage of the first signal and a voltage of the second signal drop at an equal rate. Therefore, the distortion of the video signal is prevented.

Even if the size of the plasma display panel become larger, the distortion of the video signal supplied to the address electrode or the influence of the electromagnetic interference (EMI) and the noise on the video signal are minimized.

Figure 6A:
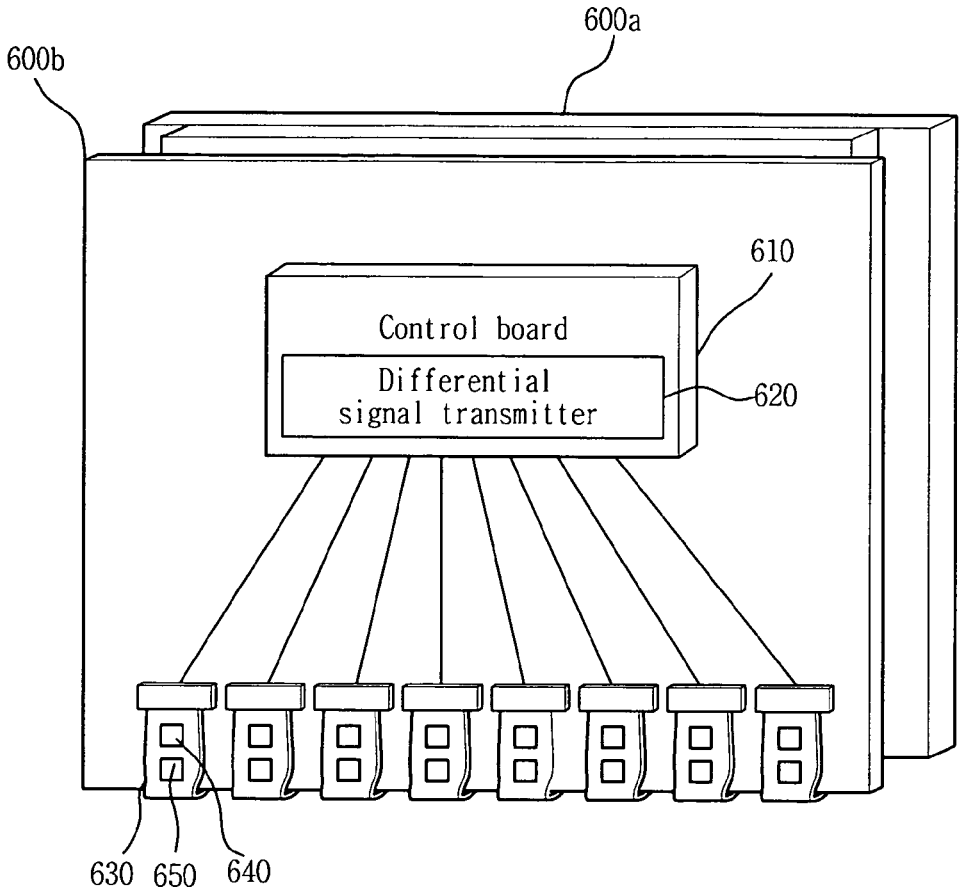
FIGS. 6*a* and 6*b* illustrate an example of achieving the plasma display apparatus according to the embodiment.
Figure 6B:
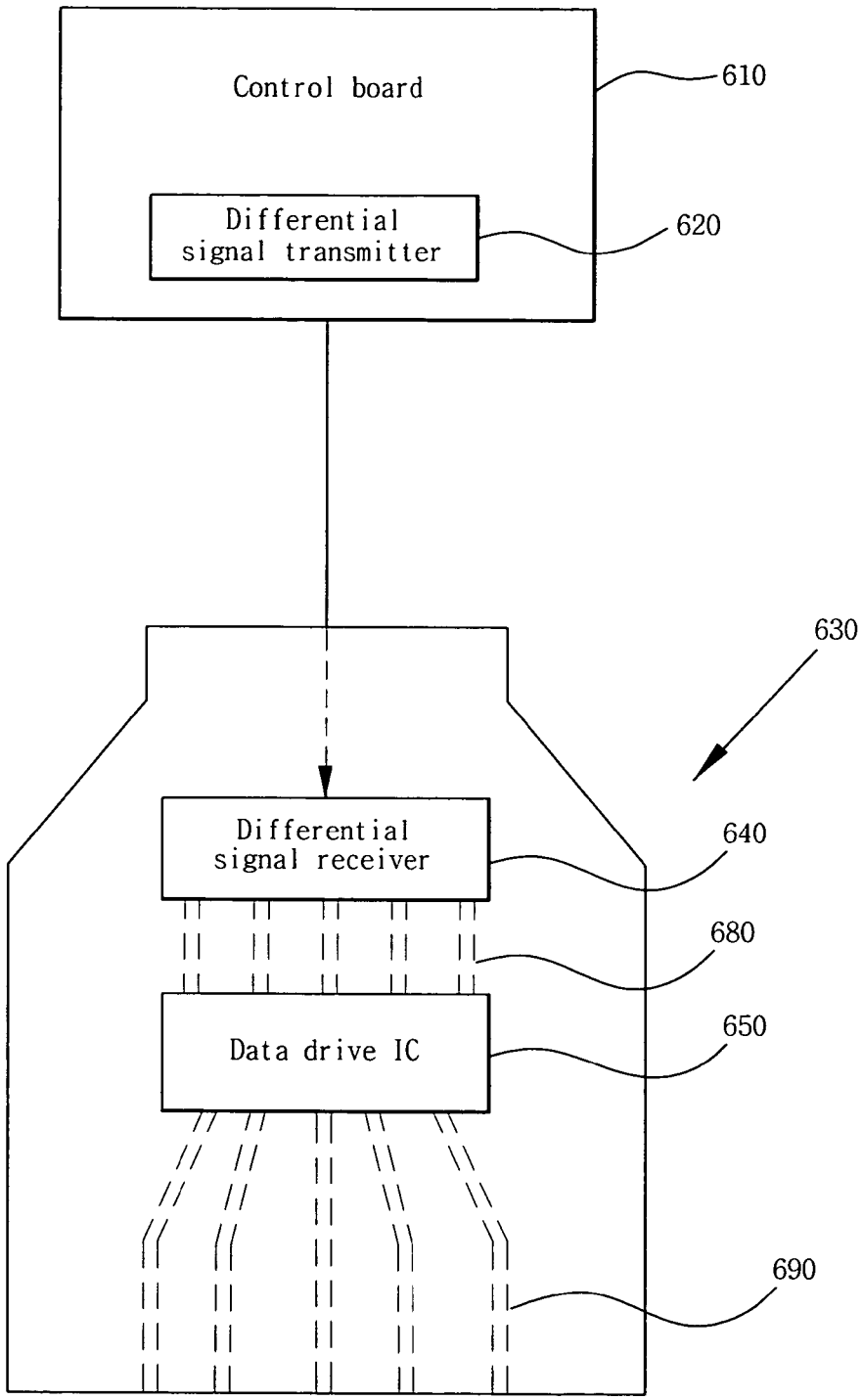

FIGS. 6*a* and 6*b* illustrate an example of achieving the plasma display apparatus according to the embodiment.

Referring to FIGS. 6*a* and 6*b*, a frame 600*b* is disposed on a rear surface of a plasma display panel 600*a*. A control board 610 capable of mounting driving circuits to control an operation of the plasma display panel 600*a* is disposed on the frame 600*b*.

A differential signal transmitter 620 is formed on the control board 610. As above, since the differential signal transmitter 620 is formed on the control board 610, the image processing such as the inverse-gamma correction, the gain control, the halftone control, the subfield mapping, the data arrangement is performed on the control board 610.

A differential signal receiver 640 and a data drive IC 650 may be formed on a data driver.

The data drive IC 650 having a plurality of channels connected to the address electrodes of the plasma display panel is disposed on the frame 600*b*.

It is preferable that the data drive IC 650 is formed on a flexible substrate 630 having flexibility.

As above, since the data drive IC 650 is formed on the flexible substrate 630, the address electrode of the plasma display panel are disposed on a face opposite a face of the frame 600*b* on which the control board 610 is disposed It is preferable that one or more data drive ICs 650 are formed on one flexible substrate 630.

It is preferable that both the differential signal receiver 640 and the data drive IC 650 are together disposed on the flexible substrate 630.

As above, since the differential signal receiver 640 and the data drive IC 650 are formed together on the flexible substrate 630, the number of channels for each chip is relatively reduced in a communication manner (for example, a manner of a low voltage differential signal) used in the differential signal receiver 640.

For example, 128-bit on-chip parallel bus is connected in series to eight different channels such that the total number of pins for each chip is reduced.

As above, the differential signal receiver 640 and the data drive IC 650 are formed together on the flexible substrate 630, and an additional data board is omitted, thereby reducing the manufacturing cost of the plasma display apparatus.

Referring to FIG. 6*b*, five paths 680 of the differential signal supplied from the differential signal receiver 640 to the data drive IC 650 are formed on the flexible substrate 630.

Further, five paths 690 of the differential signal supplied from the data drive IC 650 to the address electrode are formed on the flexible substrate 630. The number of paths 680 and 690 may be controlled.

Figure 7:
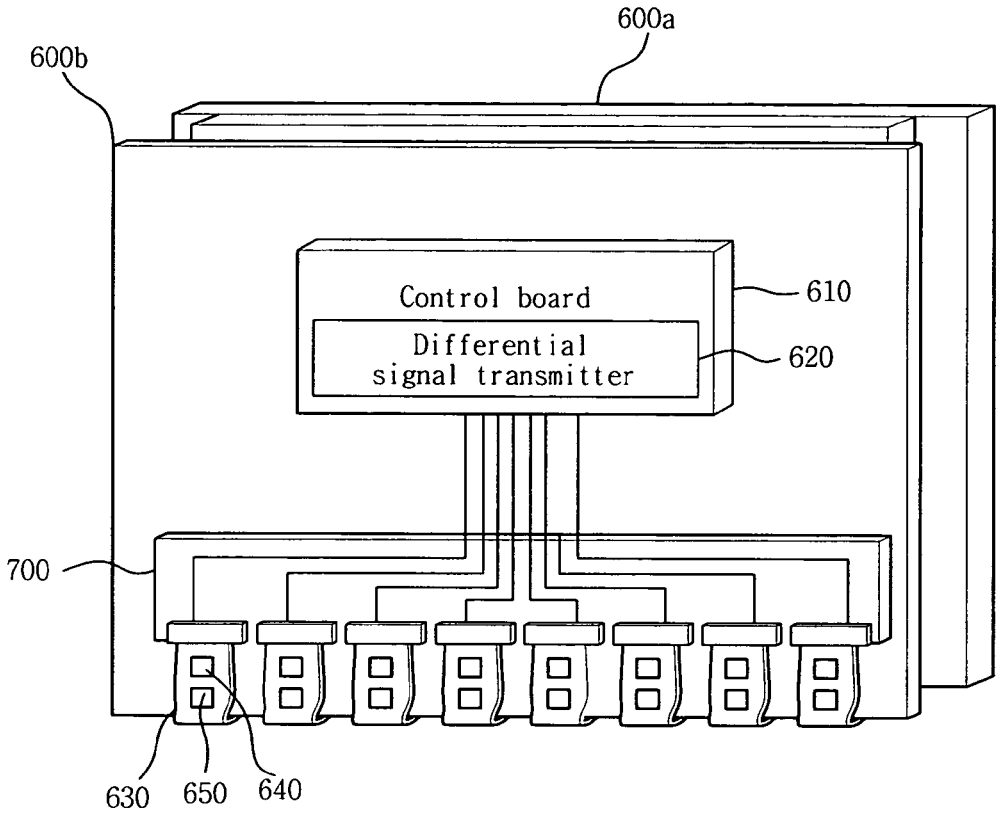
FIG. 7 illustrates another example of achieving the plasma display apparatus according to the embodiment.

FIG. 7 illustrates another example of achieving the plasma display apparatus according to the embodiment.

Referring to FIG. 7, unlike FIG. 6*a*, a data board 700 may be disposed on the frame 600*b*.

The data board 700 makes the disposition of the flexible substrate 630 easy.

Further, a transmission lime connected from the differential signal transmitter 620 to the differential signal receiver 640 may be formed on the data board 700.

As compared FIG. 6*a* with FIG. 7, the connection of the differential signal transmitter 620 and the plurality of differential signal receivers 640 is easier in FIG. 7.

The differential signal receiver 640 and the data driver IC 650 may be integrated with each other in the form of one chip. This will be described with reference to FIG. 8.

Figure 8:
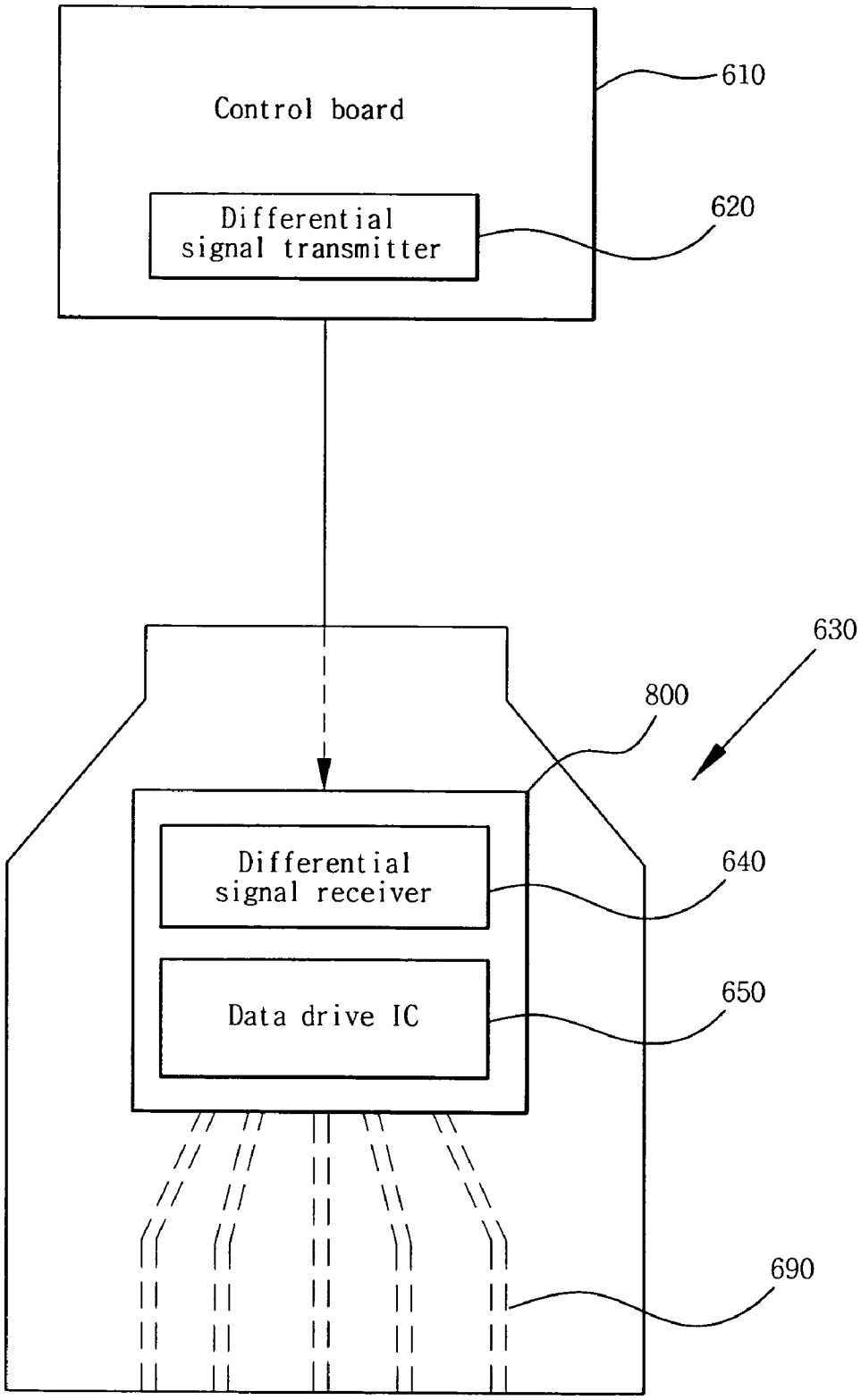
FIG. 8 illustrates the integration of a differential signal receiver and a data drive integrated circuit in the plasma display apparatus according to the embodiment.

FIG. 8 illustrates the integration of a differential signal receiver and a data drive integrated circuit in the plasma display apparatus according to the embodiment.

Referring to FIG. 8, as described above, a noise greatly decreases in the communication manner (for example, the manner of the low voltage differential signal) used in the differential signal receiver 640. Therefore, the differential signal receiver 640 and the data drive IC 650 may be integrated with each other in the form of one chip 800 on the flexible substrate 630.

In other words, a function of the differential signal receiver 640 may be added to the data drive IC 650, or the differential signal receiver 640 may perform a function of the data drive IC 650.

A case where the whole plasma display panel is driven by supplying the video signal in one direction of the address electrode has been so far described.

However, in a case where the size of the plasma display panel becomes larger, it is preferable that the video signal is supplied to the address electrode in both directions of the plasma display panel such that the whole plasma display panel is driven. This will be described with reference to FIG. 9.

Figure 9:
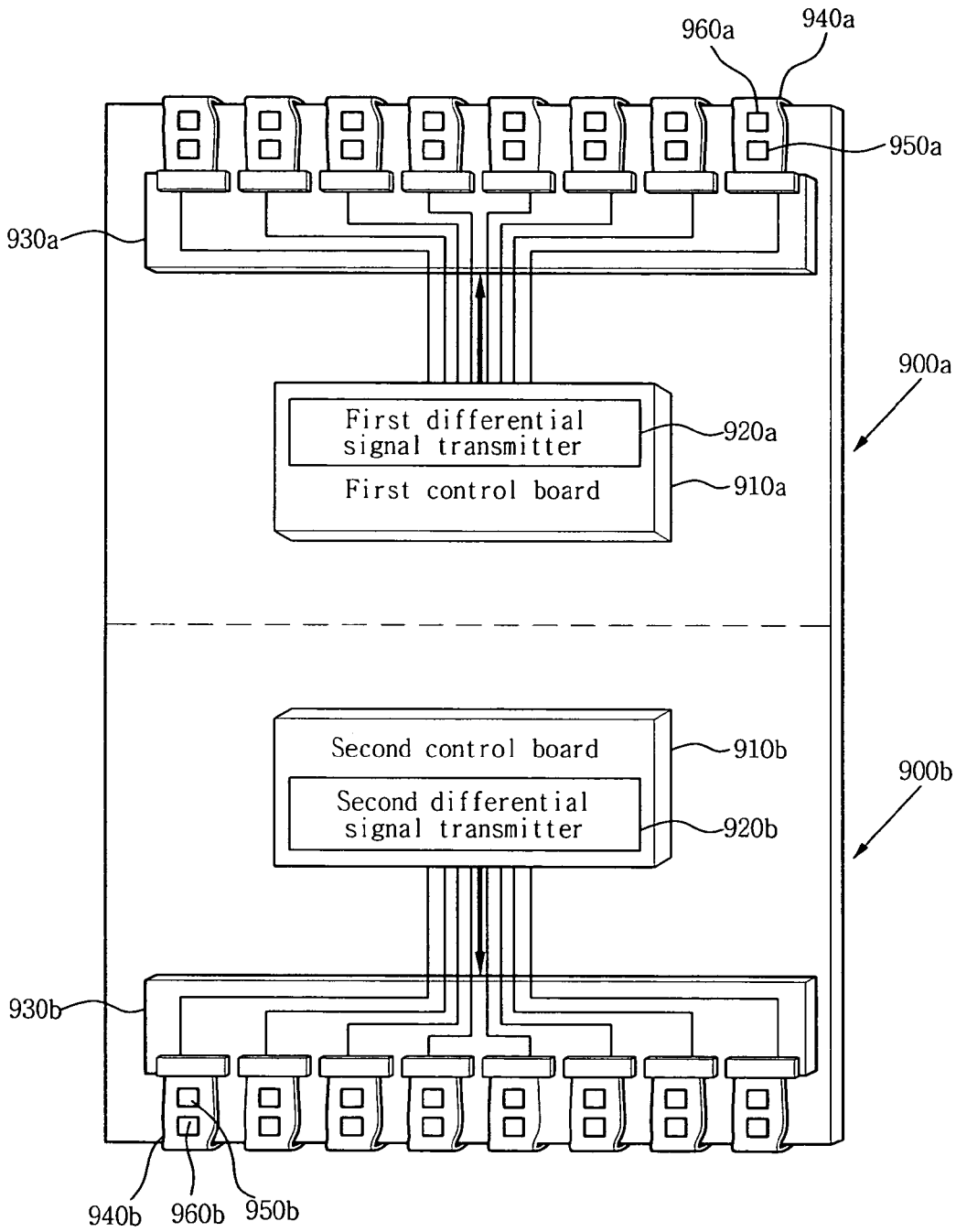
FIG. 9 illustrates a method of driving the whole plasma display panel by supplying a video signal to an address electrode in both directions of the plasma display panel of the plasma display apparatus according to the embodiment.

FIG. 9 illustrates a method of driving the whole plasma display panel by supplying a video signal to an address electrode in both directions of the plasma display panel of the plasma display apparatus according to the embodiment.

Referring to FIG. 9, one plasma display panel is divided into a plurality of screen areas, for example, a first screen area 900*a* and a second screen area 900*b*.

Although it is not illustrated in FIG. 9, a first address electrode group is formed in the first screen area 900*a* and a second address electrode group is formed in the second screen area 900*b*.

The address electrodes of the first address electrode group are physically insulated from the address electrodes of the second address electrode group.

A first driver for driving the first address electrode group and a second driver for driving the second address electrode group each include control boards 910*a* and 910*b*, differential signal transmitters 920*a* and 920*b*, differential signal receivers 950*a* and 950*b*, and data drive ICs 960*a* and 960*b*.

For example, the first driver for driving the first address electrode group on the-first screen area 900*a* includes a first data driver. The first data driver includes the first differential signal transmitter 920*a* on the first control board 910*a*, the first differential signal receiver 950*a* on a first flexible substrate 940*a*, and the first data drive IC 960*a*.

Further, the second driver for driving the second address electrode group in the second screen area 900*b* includes a second data driver. The second data driver includes the second differential signal transmitter 920*b* on the second control board 910*b*, the second differential signal receiver 950*b* on a second flexible substrate 940*b*, and the second data drive IC 960*b*.

As above, since one plasma display panel is driven with it being divided into the plurality of screen areas, time required in scanning all discharge cells formed in the plasma display panel is reduced such that driving time is sufficiently secured.

Accordingly, the driving efficiency of the plasma display apparatus according to the embodiment increases.

Although FIG. 9 illustrates a case where the differential signal receivers 950*a* and 950*b* and the data drive ICs 960*a* and 960*b* are formed separately as illustrated in FIG. 7, as illustrated in FIG. 8, the differential signal receivers 950*a* and 950*b* and the data drive ICs 960*a* and 960*b* may be formed to be integrated with each other in the form of one chip.

The following is a detailed description of the differential signal transmitter and the differential signal receiver of the plasma display apparatus according to the embodiment.

Figure 10:
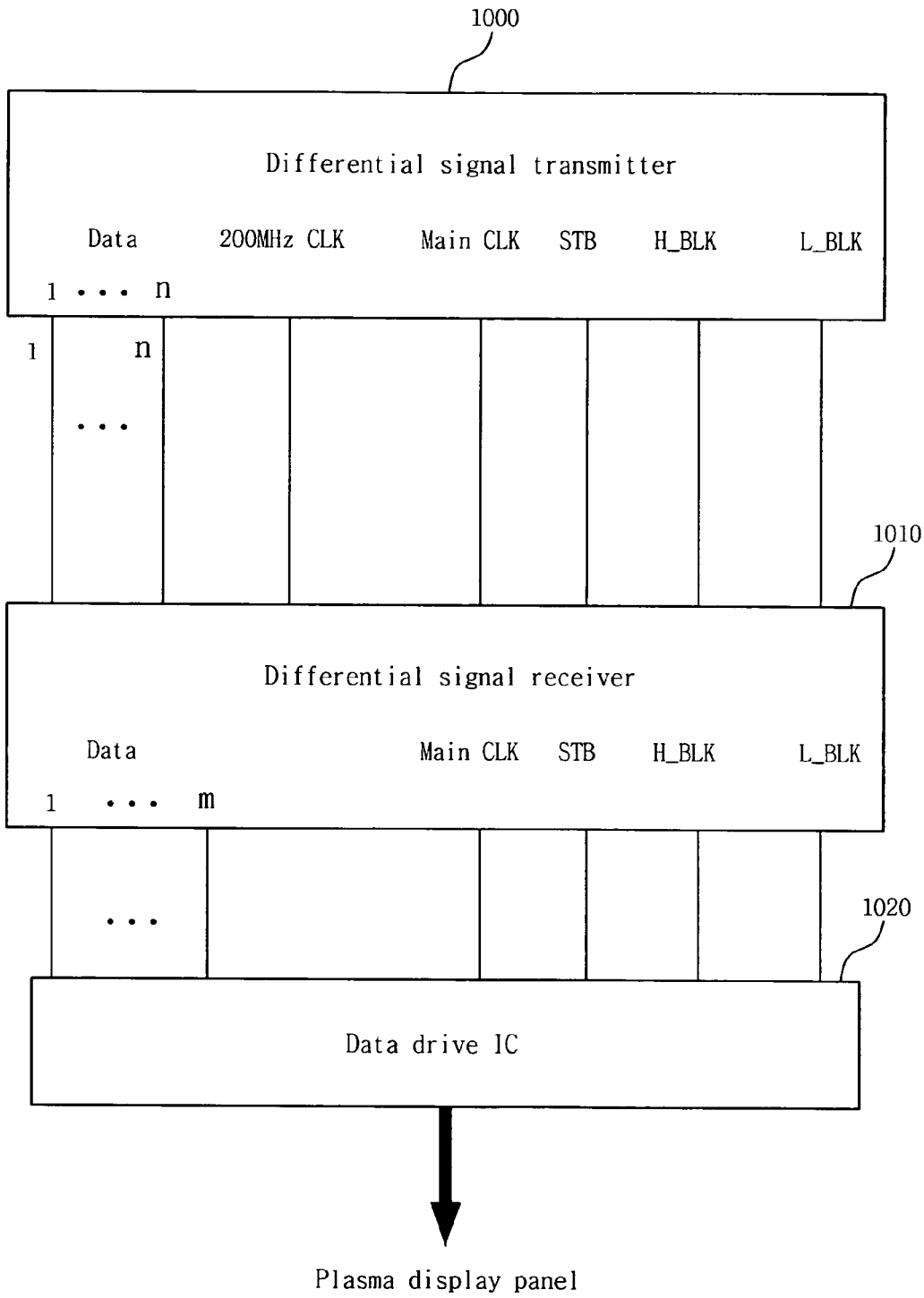
FIG. 10 illustrates a differential signal transmitter and a differential signal receiver of the plasma display apparatus according to the embodiment.

FIG. 10 illustrates a differential signal transmitter and a differential signal receiver of the plasma display apparatus according to the embodiment.

Referring to FIG. 10, it is preferable that the differential signal includes a differential data signal and a differential clock signal. The differential clock signal controls the transmission of the differential data signal and has a frequency of 200 MHz or more.

The differential data signal is transmitted from a differential signal transmitter 1000 to a differential signal receiver 1010 through a data transmission line. The differential clock signal is transmitted from the differential signal transmitter 1000 to the differential signal receiver 1010 through a clock transmission line.

Between the differential signal transmitter 1000 and the differential signal receiver 1010, a first differential data transmission line to an n-th differential data transmission line are formed.

Further, differential clock transmission lines are formed between the differential signal transmitter 1000 and the differential signal receiver 1010.

Since the differential signal includes the first signal and the second signal as described above, the data transmission lines used to transmit the differential data signal are formed in pairs, and also, the clock transmission lines used to transmit the differential clock signal are formed in pairs.

Between the differential signal transmitter 1000 and the differential signal receiver 1010, a main clock signal transmission line for the transmission of a main clock signal (Main CLK), a strobe signal transmission line for the transmission of a strobe signal (STB), a high blanking signal transmission line for the transmission of a high blanking signal (H_BLK), a low blanking signal transmission line for the transmission of a low blanking signal (L_BLK) are formed.

The main clock signal (Main CLK), the strobe signal (STB), the high blanking signal (H_BLK), and the low blanking signal (L_BLK) may be transmitted in a parallel transmission manner, for example, in a transistor-transistor logic (TTL) manner.

The main clock signal (Main CLK) is a clock for an operation of a data drive IC 1020, and preferably has a frequency of substantially 50 MHz.

The differential signal receiver 1010 receives the main clock signal (Main CLK), the strobe signal (STB), the high blanking signal (H_BLK), and the low blanking signal (L_BLK) from the differential signal transmitter 1000, and then transmits the received signals to the data drive IC 1020.

Further, the differential signal receiver 1010 restores an original video signal from the differential data signal using a voltage difference between a first signal and a second signal being an inverted signal of the first signal.

The differential signal receiver 1010 may transmit the restored video signal to the data drive IC 1020 using the TTL manner or the differential clock signal having a frequency of 200 MHz or more.

As above, the transmission manner of the video signal from the differential signal receiver 1010 to the data drive IC 1020 may be variously changed.

Figure 11:
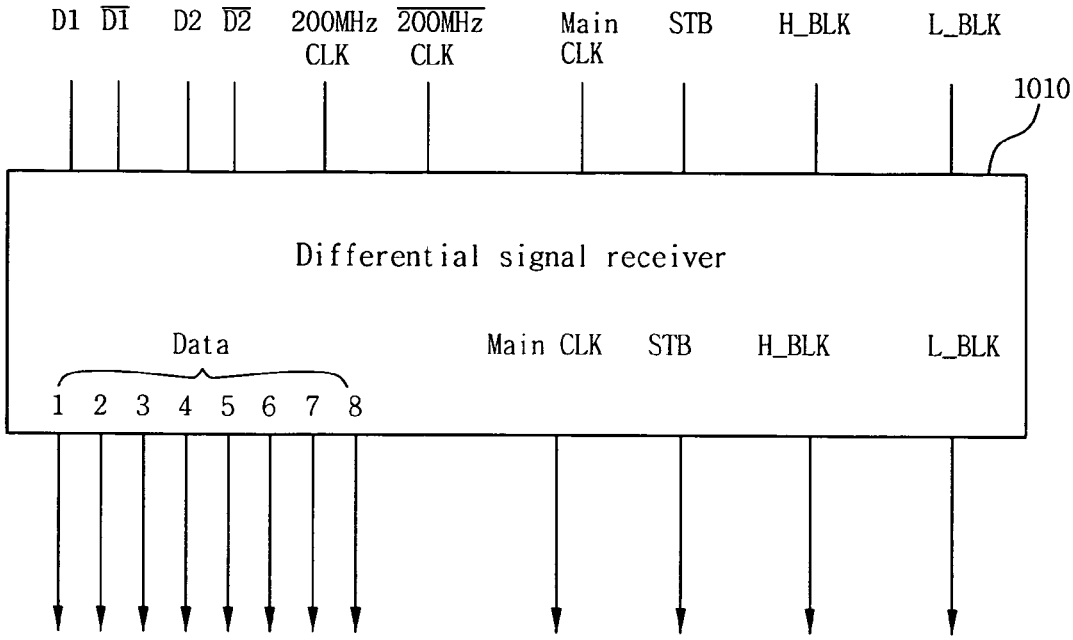
FIG. 11 illustrates an example of achieving a differential signal receiver of the plasma display apparatus according to the embodiment.

The following is a detailed description of the differential signal receiver 1010, with reference to FIG. 11.

FIG. 11 illustrates an example of achieving a differential signal receiver of the plasma display apparatus according to the embodiment.

Referring to FIG. 11, the differential data signal is transmitted to the differential signal receiver 1010 through a D1 data line and a D1 bar data line differential-paired with the D1 data line, and a D2 data line and a D2 bar data line differential-paired with the D2 data line.

The differential clock signal is transmitted to the differential signal receiver 1010 through a 200 MHz clock line and a 200 MHz bar clock line differential-paired with the 200 MHz clock line.

The differential signal receiver 1010 restores the original video signal from the differential data signal using a voltage difference between the first signal and the second signal being an inverted signal of the first signal.

In particular, in FIG. 11, the differential signal receiver 1010 restores an 8-bit video signal, i.e., the video signal of the TTL manner.

The differential signal receiver 1010 may transmit the restored video signal of the TTL manner using 8 data lines to the data driver IC.

The embodiment sets the differential clock signal to a frequency of 200 MHz or more. This reason will be described in detail with reference to FIG. 12*a* and 12*b*.

Figure 12A:
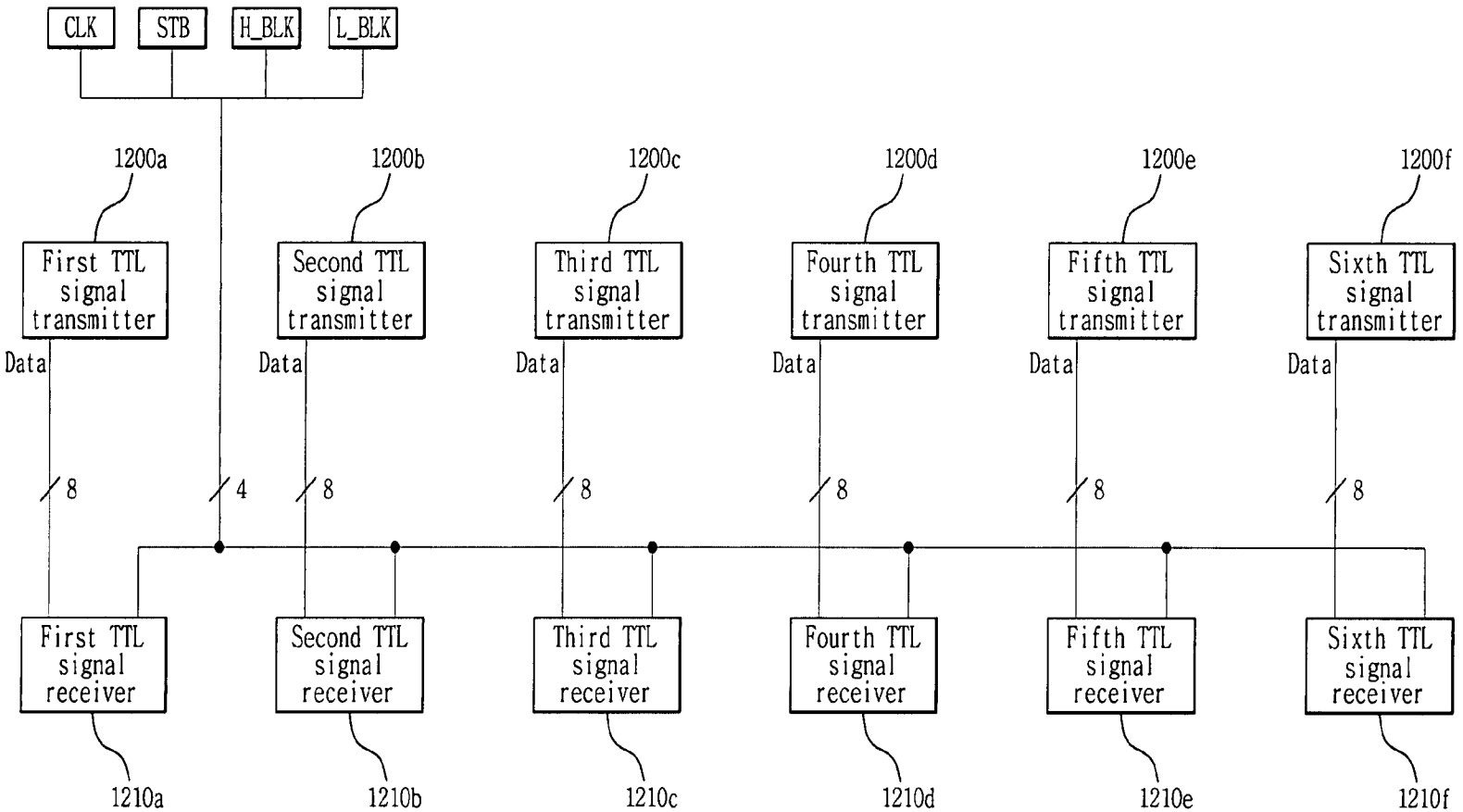
FIGS. 12*a* and 12*b* illustrate a reason for setting a differential clock signal to a frequency of 200 MHz or more.
Figure 12B:
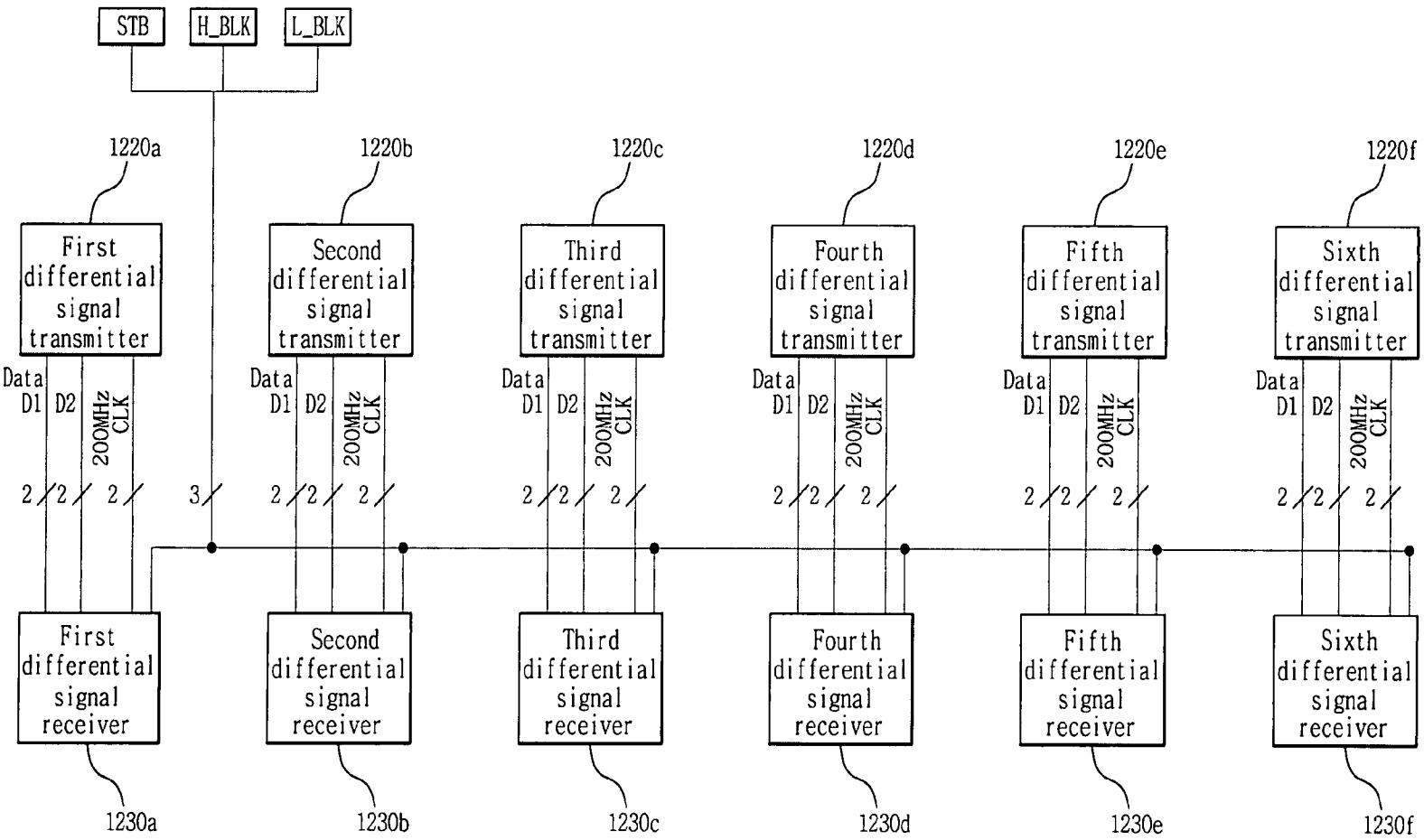

FIG. 12*a* and 12*b* illustrate a reason for setting a differential clock signal to a frequency of 200 MHz or more.

FIG. 12*a* illustrates an example of a method for transmitting the video signal using the TTL manner.

For example, assuming that the data drive IC includes a total of 256 channels connected to the address electrode of the plasma display panel and operates in a main clock signal of 50 MHz.

Further, assuming that 6 data drive ICs are used, and each data drive IC uses an 8-bit input signal.

First, second, third, fourth, fifth and sixth TTL signal transmitters 1200*a*, 1200*b*, 1200*c*, 1200*d*, 1200*e* and 1200*f* convert video signals into 8-bit data. Then, the first to sixth TTL signal transmitters 1200*a* to 1200*f* transmit the 8-bit data to first, second, third, fourth, fifth and sixth TTL signal receivers 1210*a*, 1210*b*, 1210*c*, 1210*d*, 1210*e* and 1210*f*.

Each TTL signal transmitter requires 8 data lines such that a total of 48 data lines for the 6 TTL signal transmitters are required. In FIG. 12*a*, /8 indicates the 8 data lines.

When the first to sixth TTL signal receivers 1210*a* to 1210*f* receive a main clock signal of 50 MHz, a strobe signal, a high blanking signal and a low blanking signal, 4 control signal transmission lines are required.

Accordingly, when the first to sixth TTL signal transmitters 1200*a* to 1200*f* transmit the video signals to the first to sixth TTL signal receivers 1210*a* to 1210*f* in the TTL manner, a total of 52 transmission lines are required.

FIG. 12*b* illustrates an example of a method for transmitting the video signal using the differential signal.

For example, in the same way as FIG. 12*a*, assuming that the data drive IC includes a total of 256 channels connected to the address electrode of the plasma display panel and operates in a main clock signal of 50 MHz.

Further, assuming that 6 data drive ICs are used, and each data drive IC uses an 8-bit input signal.

In particular, assuming that the differential signal uses a differential clock signal of 200 MHz.

First, second, third, fourth, fifth and sixth differential signal transmitters 1220*a*, 1220*b*, 1220*c*, 1220*d*, 1220*e* and 1220*f* transmit video signals to first, second, third, fourth, fifth and sixth differential signal receivers 1230*a*, 1230*b*, 1230*c*, 1230*d*, 1230*e* and 1230*f* in a differential signal transmission manner. Since the differential signal transmission manner using the differential clock signal of 200 MHz in FIG. 12*b* is four times faster than the TTL transmission manner using 50 MHz in FIG. 12*a*, two differential data transmission lines are used.

Since two data transmission lines are required in each of a first signal and a second signal of the differential signal, four data transmission lines are required. A total of 24 data transmission lines are required in the differential signal transmission manner using the differential clock signal of 200 MHz.

Since the differential clock signal of 200 MHz transmitted from the first to sixth differential signal transmitters 1220*a* to 1220*f* to the first to sixth differential signal receivers 1230*a* to 1230*f* uses a differential clock line, two clock lines for the differential signal including the first signal and the second signal are required such that a total of 12 clock lines are required.

Further, when the first to sixth differential signal receivers 1230*a* to 1230*f* receive a strobe signal, a high blanking signal and a low blanking signal, 3 control signal transmission lines are required.

Accordingly, when the first to sixth differential signal transmitters 1220*a* to 1220*f* transmit the video signal to the first to sixth differential signal receivers 1230*a* to 1230*f* in the differential signal transmission manner, a total of 39 transmission lines are required.

After all, the differential signal transmission manner of FIG. 12*b* may use the transmission lines applied to the TTL manner of FIG. 12*a* without adding transmission lines.

On the other hand, in a case where the differential signal uses a differential clock signal of 100 MHz, a transmission speed in the differential clock signal of 100 MHz is one half the transmission speed in FIG. 12*b*. Therefore, four differential data transmission line for each of the first signal and the second signal are required. Therefore, a total of 48 differential data transmission lines are used.

Further, since the differential clock signal of 100 Mz uses differential clock lines, two clock lines for the differential signal including the first signal and the second signal are required such that a total of 12 clock lines are required. Further, 3 control signal transmission lines are required in the transmission of a strobe signal, a high blanking signal and a low blanking signal.

A total of 63 transmission lines are required in the differential signal transmission manner using the differential clock signal of 100 MHz.

Accordingly, when the differential signal transmission manner using the differential clock signal of 100 MHz uses the transmission lines applied to the TTL manner in FIG. 12*a*, 11 transmission lines need to be added.

In other words, when the differential signal transmission manner using the differential clock signal of 100 MHz uses the transmission lines applied to the TTL manner in FIG. 12*a*, additional expense may occur.

On the other hand, in a case where the differential signal uses a differential clock signal of 400 MHz, a transmission speed in the differential clock signal of 400 MHz is two times faster than a transmission speed in FIG. 12*b*. Therefore, one differential data transmission line for each of the first signal and the second signal is required. Therefore, a total of 12 differential data transmission lines are required.

Further, since the differential clock signal of 400 MHz uses a differential clock line, two clock lines for the differential signal including the first signal and the second signal is required such that a total of 12 clock lines are required. Further, 3 control signal transmission lines are required in the transmission of a strobe signal, a high blanking signal and a low blanking signal A total of 27 transmission lines are required in the differential signal transmission method using the differential clock signal of 400 MHz.

As above, it is preferable that the differential clock signal is set to a frequency of 200 MHz or more, for example, 200 MHz it or 400 MHz.

The differential clock signal having a frequency of 200 MHz or more may be commonly used in two or more differential signal receivers. This will be described in detail with reference to FIG. 13.

Figure 13:
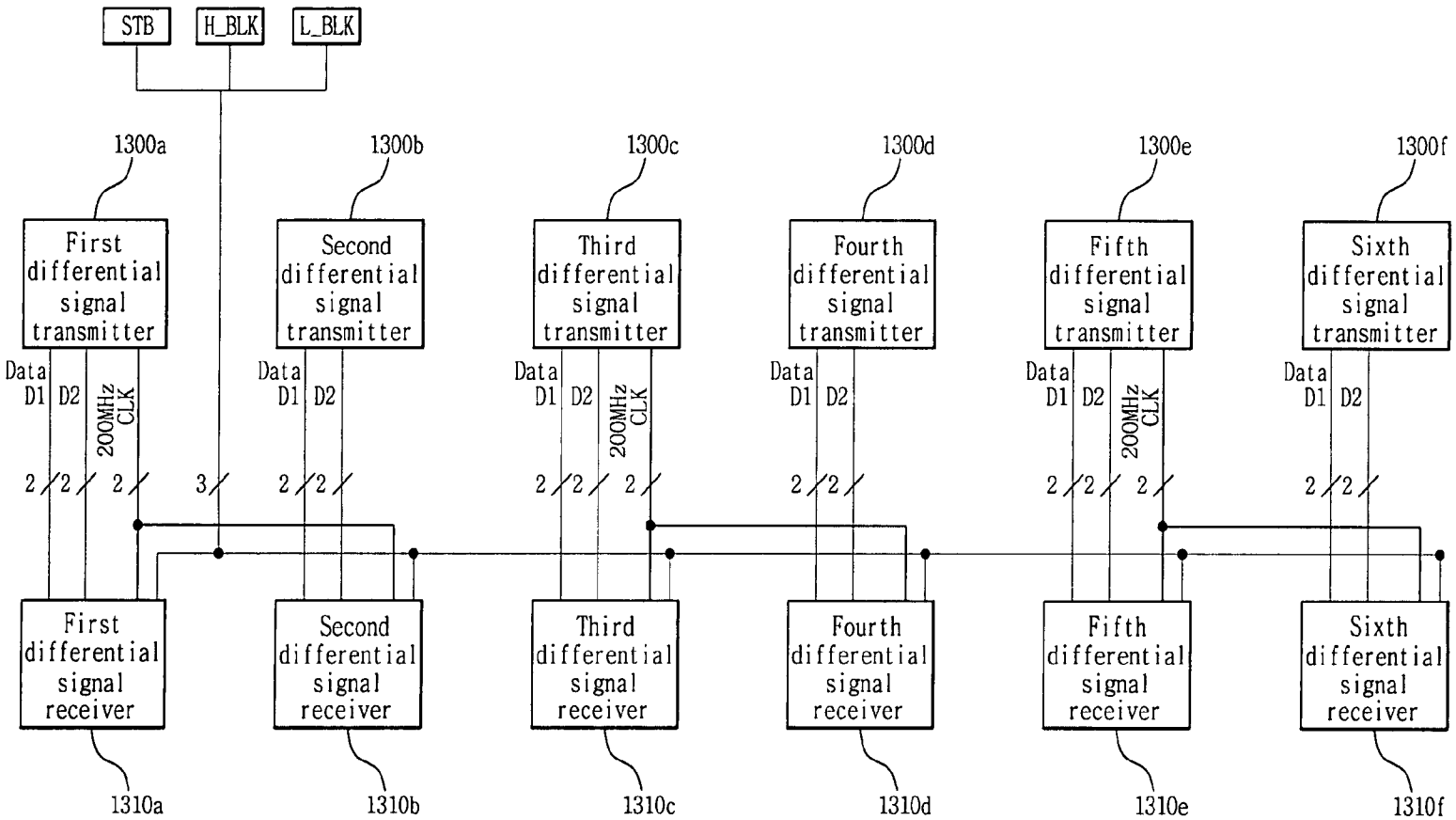
FIG. 13 illustrates an example of a method for commonly using a differential clock signal.

FIG. 13 illustrates an example of a method for commonly using a differential clock signal.

Referring to FIG. 13, a first differential signal receiver 1310*a* and a second differential signal receiver 1310*b* commonly use a differential clock signal of 200 MHz.

Further, a third differential signal receiver 1310*c* and a fourth differential signal receiver 1310*d* commonly use a differential clock signal of 200 MHz. A fifth differential signal receiver 1310*e* and a sixth differential signal receiver 1310*f* commonly use a differential clock signal of 200 MHz.

As compared FIG. 12*b* with FIG. 13, 6 transmission lines are not used.

A total number of transmission lines is reduced, thereby reducing the whole size of the data driver.

Figure 14:
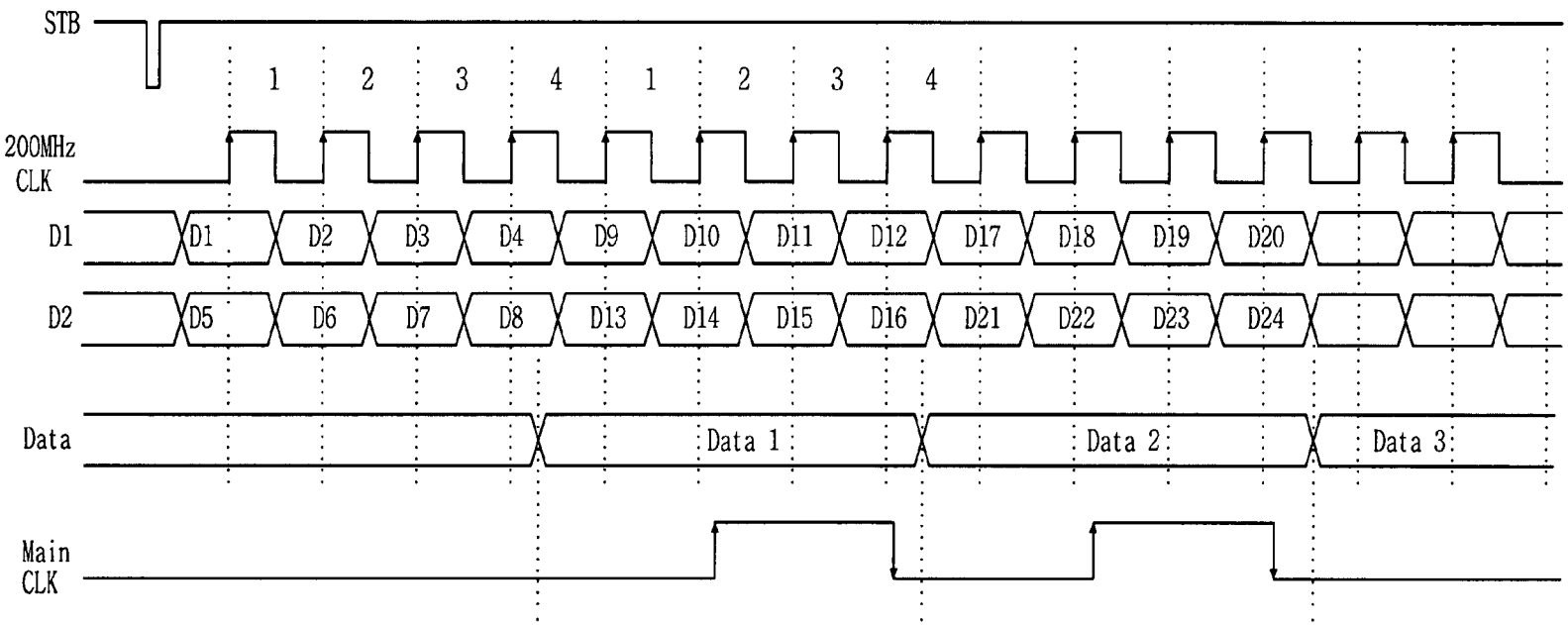
FIG. 14 illustrates a first method for transmitting and receiving data between a differential signal transmitter and a differential signal receiver in the plasma display apparatus according to the embodiment.
Figure 15:
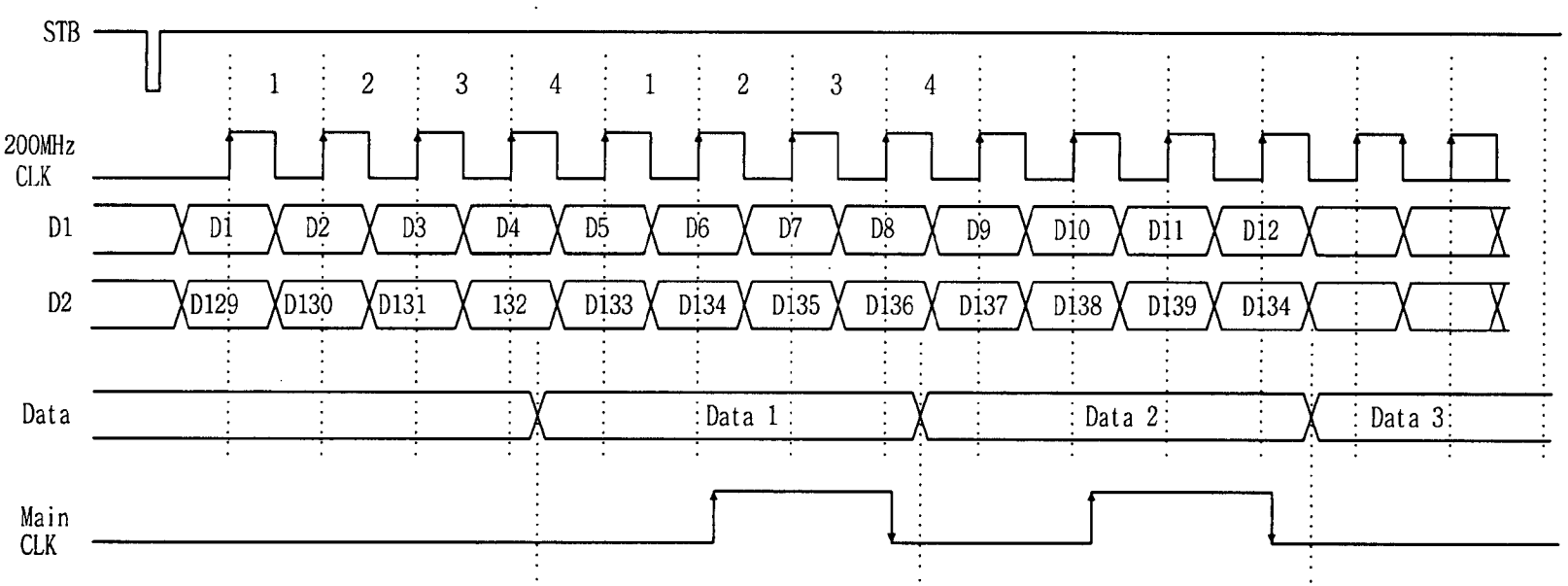
FIG. 15 illustrates a second method for transmitting and receiving data between a differential signal transmitter and a differential signal receiver in the plasma display apparatus according to the embodiment.

The following is a detailed description of a method for transmitting and receiving data between a differential signal transmitter and a differential signal receiver, with reference to FIGS. 14 and 15.

FIG. 14 illustrates a first method for transmitting and receiving data between a differential signal transmitter and a differential signal receiver in the plasma display apparatus according to the embodiment.

FIG. 15 illustrates a second method for transmitting and receiving data between a differential signal transmitter and a differential signal receiver in the plasma display apparatus according to the embodiment.

First, referring to FIG. 14, after the differential signal transmitter supplies the strobe signal (STB), the differential signal transmitter reads first data (D1) and fifth data (D5) supplied to a first data line D1 and a second data line D2 at a first rising edge of a differential clock signal of 200 MHz. In other words, the differential signal transmitter transmits the first data (D1) and the fifth data (D5) to the differential signal receiver.

The differential signal transmitter reads second data (D2) and sixth data (D6) supplied to the first data line D1 and the second data line D2 at a second rising edge of the differential clock signal of 200 MHz.

The differential signal transmitter reads third data (D3) and seventh data (D7) supplied to the first data line D1 and the second data line D2 at a third rising edge of the differential clock signal of 200 MHz. Further, the differential signal transmitter reads fourth data (D4) and eighth data (D8) supplied to the first data line D1 and the second data line D2 at a fourth rising edge of the differential clock signal of 200 MHz.

As above, the differential signal transmitter reads a video signal corresponding to 50 MHz for each data line at a total of 4 rising edges of the differential clock signal of 200 MHz. Therefore, the differential signal transmitter reads a video signal corresponding to total of 100 MHz at the total of 4 rising edges of the differential clock signal of 200 MHz.

The differential signal transmitter reads a video signal corresponding to total of 100 MHz at a total of next 4 rising edges of the differential clock signal of 200 MHz.

Thus, the differential signal transmitter reads a video signal corresponding to total of 200 MHz at a total of 8 rising edges of the differential clock signal of 200 MHz.

It is possible to transmit the video signal, which the differential signal transmitter reads, to the differential signal receiver using the TTL manner or the transmission manner using the differential clock signal having a frequency of 200 MHz or more.

The differential signal receiver reads the video signal, which the differential signal transmitter transmits, using the main clock.

The data transmission and reception between the differential signal transmitter and the differential signal receiver are performed using the above-described manner.

Although FIG. 14 has illustrated and described only the manner using the rising edges of the differential clock signal of 200 MHz, both the rising edges and falling edges of the differential clock signal of 200 MHz may be used.

Furthermore, in a case where the number of differential signal transmitters is plural, a supply time point of a differential clock signal of 200 MHz in at least one of the plurality of differential signal transmitters may be different from a supply time point of a differential clock signal of 200 MHz in the other differential signal transmitters.

In other words, the differential clock signals of 200 MHz in all the differential signal transmitters may be synchronized. At least one of the plurality of differential signal transmitters may use the differential clock signals of 200 MHz at a supply time point different from a supply time point of the other differential signal transmitters.

In other words, at least one of the plurality of differential signal transmitters may use the differential clock signals of 200 MHz after shifting the differential clock signals of 200 MHz.

In FIG. 15, the differential signal transmitter reads the video signal in order different from the order illustrated in FIG. 14.

Referring to FIG. 15, after the differential signal transmitter supplies the strobe signal (STB), the differential signal transmitter reads first data (D1) and 129th data (D129) supplied to a first data line D1 and a second data line D2 at a first rising edge of a differential clock signal of 200 MHz. In other words, the differential signal transmitter transmits the first data (D1) and the 129th data (D129) to the differential signal receiver.

The differential signal transmitter reads second data (D2) and 130th data (130) supplied to the first data line D1 and the second data line D2 at a second rising edge of the differential clock signal of 200 MHz.

The differential signal transmitter reads third data (D3) and 131st data (D131) supplied to the first data line D1 and the second data line D2 at a third rising edge of the differential clock signal of 200 MHz. Further, the differential signal transmitter reads fourth data (D4) and 132nd data (D132) supplied to the first data line D1 and the second data line D2 at a fourth rising edge of the differential clock signal of 200 MHz.

As above, the differential signal transmitter may read the video signal in various orders at the rising edge of the differential clock signal of 200 MHz.

Since the plasma display apparatus according to the embodiment transmits the video signal using the differential signal, a noise and an influence of electromagnetic interference (EMI) are reduced, and thus the image quality is improved.

The width of the scan pulse supplied during the address period can be reduced by a reduction in the noise. This will be described in detail, with reference to FIGS. 16 and 17.

Figure 16:
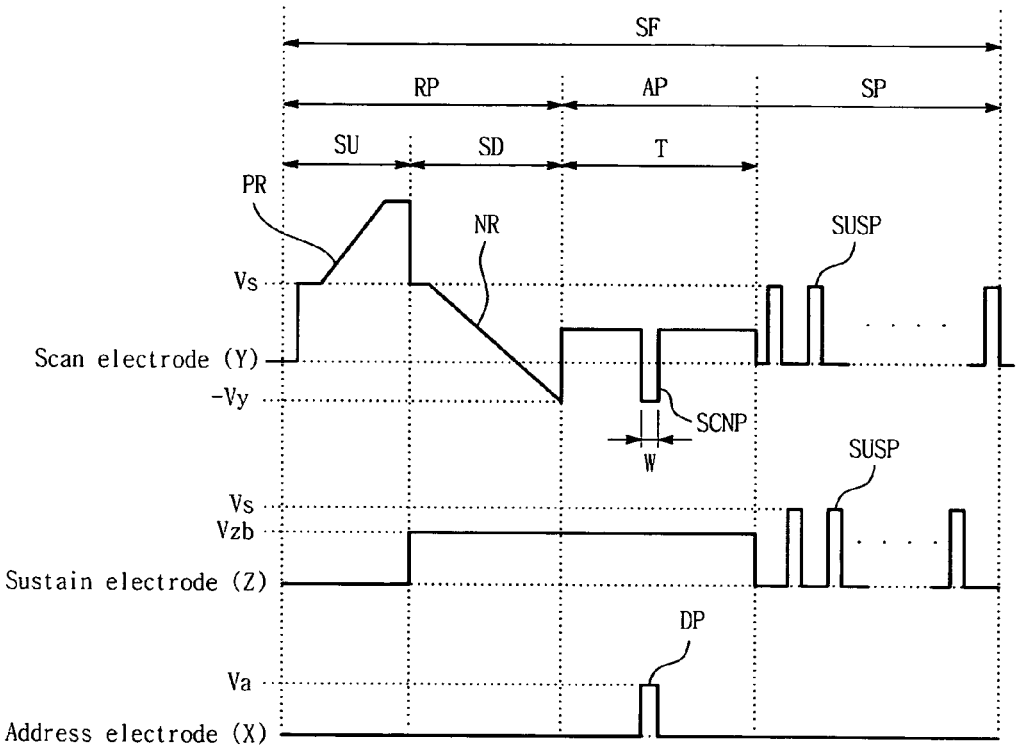
FIG. 16 illustrates a driving waveform generated in the plasma display apparatus according to the embodiment.

FIG. 16 illustrates a driving waveform generated in the plasma display apparatus according to the embodiment. FIG. 17 illustrates a discharge characteristic depending on a change in the width of a scan signal of a driving waveform generated in the plasma display apparatus according to the embodiment.

As illustrated in FIG. 16, each subfield SF is divided into a reset period RP for initializing discharge cells of the whole screen, an address period AP for selecting cells to be discharged, and a sustain period SP for maintaining discharges of the selected cells.

The reset period RP is further divided into a setup period SU and a set-down period SD. During the setup period SU, a rising pulse PR is simultaneously supplied to all the scan electrodes Y. The rising pulse PR generates a weak discharge (i.e., a setup discharge) within the discharge cells of the whole screen, thereby forming wall charges in the discharge cells.

During the set-down period SD, a falling pulse NR, which falls from a positive sustain voltage Vs lower than the highest voltage of the rising pulse PR to a negative scan voltage −Vy, is simultaneously supplied to the scan electrodes Y, thereby generating a weak erase discharge (i.e., a set-down discharge) within the discharge cells. The set-down discharge erases unnecessary charges of the wall charges and space charges generated through the setup discharge such that the remaining wall charges are uniform inside the discharge cells to the extent that the address discharge can be stably performed.

During the address period AP, a scan pulse SCNP of a negative polarity is sequentially supplied to the scan electrodes Y and, at the same time, a data pulse DP of a positive polarity is selectively supplied to the address electrodes X.

As the voltage difference between the scan pulse SCNP and the data pulse DP is added to the wall voltage generated during the reset period RP, an address discharge occurs within the discharge cells to which the data pulse DP is supplied. Wall charges are formed inside the discharge cells selected by performing the address discharge Since the plasma display apparatus according to the embodiment transmits the video signal using the differential signal, a noise is reduced such that the discharge is stably generated. Further, a width W of the scan pulse can be reduced by the stable discharge.

It is preferable that the width W of the scan pulse SCNP ranges from 0.6 μs to 1.2 μs.

As above, since the width W of the scan pulse SCNP supplied during the address period is reduced to 0.6-1.2 μs, in a case of the large-sized plasma display panel, a duration T of the address period AP for scanning all the discharge cells does not excessively increase. Therefore, a single scanning driving is possible.

Further, since the duration T of the address period AP decreases, a duration of the sustain period in one subfield is sufficiently secured such that the high-definition image is achieved.

A reason to set the largest value of the width W of the scan pulse SCNP to 1.2 μs, as illustrated in FIG. 17, is a maximum value capable of performing the single scanning driving.

Further, when the width W of the scan pulse SCNP is less than 0.6 μs, the address discharge may not occur. In other words, 0.6 μs is a minimum value capable of performing the single scanning driving while the address discharge occurs stably.

A positive bias voltage Vzb is supplied to the sustain electrodes Z during the set-down period SD and the address period AP.

During the sustain period SP, sustain pulses SUSP are alternately supplied to the scan electrodes Y and the sustain electrodes Z. As the wall voltage within the discharge cells selected by performing the address discharge is added to the sustain pulses SUSP, every time the sustain pulse is applied, a sustain discharge (i.e., a display discharge) of a surface discharge type occurs between the scan electrodes Y and the sustain electrodes Z.

The driving of the plasma display apparatus is completed through the above-described-driving processes.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus, comprising:

a plasma display panel including an address electrode;

a control board that converts a video signal into a differential signal and transmits the differential signal, wherein the differential signal includes a first signal and a second signal being an inverted signal of the first signal and has a frequency of 200 MHz or more; and a data driver that receives the differential signal, restores the video signal from the differential signal, and supplies the restored video signal to the address electrode of the plasma display panel, wherein a voltage level difference between the first signal and the second signal substantially ranges from 0.1V to 0.5V, wherein:

the control board includes or is coupled to a differential signal transmitter and the data driver includes or is coupled to a differential signal receiver, the differential signal transmitter transmits a main clock signal, a strobe signal, a high blanking signal, and a low blanking signal to the differential signal receiver, wherein the main clock signal, strobe signal, high blanking signal, and low blanking signal are transmitted in a transistor-transistor logic (TTL) manner, the differential signal receiver transmits the main clock signal, the strobe signal, the high blanking signal, and the low blanking signal to the data driver, the main clock signal is a clock signal for an operation of the data driver and has a frequency of substantially 50 MHz, the data driver is coupled to a data board, one or more transmission lines, formed on the data board, are coupled between the differential signal transmitter and the different signal receiver, and the differential signal includes a differential data signal which is subfield-mapped and rearranged for the address electrode and a differential clock signal for controlling transmission of the differential data signal.

2. The plasma display apparatus of claim 1, wherein the control board includes the differential signal transmitter that converts the video signal into the differential signal and transmits the differential signal, and wherein the data driver includes the differential signal receiver that receives the differential signal and restores the video signal from the differential signal, and a data drive integrated circuit that supplies the restored video signal by the differential signal receiver to the address electrode of the plasma display panel through a switching operation.

3. The plasma display apparatus of claim 2, wherein the differential clock signal substantially has a frequency of 200 MHz.

4. The plasma display apparatus of claim 2, wherein the differential clock signal substantially has a frequency of 400 MHz.

5. The plasma display apparatus of claim 1, wherein the differential signal receiver includes a first differential signal receiver and a second differential signal receiver, and the first differential signal receiver and the second differential signal receiver commonly use the differential clock signal.

6. A plasma display apparatus, comprising:

a plasma display panel including an address electrode;

a differential signal transmitter that converts a video signal into a differential signal and transmits the differential signal, wherein the differential signal includes a first signal and a second signal being an inverted signal of the first signal and having a frequency of 200 MHz or more;

a differential signal receiver that receives the differential signal and restores the video signal from the differential signal; and a data driver that supplies the restored video signal to the address electrode of the plasma display panel, wherein a voltage level difference between the first signal and the second signal substantially ranges from 0.1V to 0.5V, wherein:

the differential signal transmitter transmits a main clock signal, a strobe signal, a high blanking signal, and a low blanking signal to the differential signal receiver, wherein the main clock signal strobe signal high blanking and low blanking signal are transmitted in a transistor-transistor logic (TTL) manner, the differential signal receiver transmits the main clock signal, the strobe signal, the high blanking signal, and the low blanking signal to the data driver, the main clock signal is a clock signal for an operation of the data driver and has a frequency of substantially 50 MHz, the data driver is disposed on a flexible substrate, and the flexible substrate is coupled to a data board, one or more transmission lines, formed on the data board, are coupled between the differential signal transmitter and the differential signal receiver, and the differential signal includes a differential data signal which is subfield mapped and rearranged for the address electrode, and a different clock signal for controlling transmission of the differential data signal.

7. The plasma display apparatus of claim 6, wherein the differential signal receiver and the data driver are commonly disposed on a flexible substrate, and at least one data drive integrated circuit is disposed on the flexible substrate.

8. The plasma display apparatus of claim 6, wherein the differential signal receiver and the data driver are integrated with each other in the form of one chip.

9. The plasma display apparatus of claim 6, wherein the differential signal transmitter is formed on a control board for controlling the driving of the plasma display panel.

10. The plasma display apparatus of claim 6, wherein the differential clock signal substantially has a frequency of 200 MHz.

11. The plasma display apparatus of claim 10, wherein the differential signal receiver includes a first differential signal receiver and a second differential signal receiver, and the first differential signal receiver and the second differential signal receiver commonly use the differential clock signal.

12. The plasma display apparatus of claim 6, wherein the differential clock signal substantially has a frequency of 400 MHz.

13. A method of driving a plasma display apparatus, comprising:

converting a video signal into a differential signal having a frequency of 200 MHz or more, and transmitting the differential signal;

receiving the differential signal, restoring the video signal from the differential signal, and supplying the recovered video signal to a plasma display panel;

supplying a reset pulse to a scan electrode of the plasma display panel during a reset period; and supplying a scan pulse to the scan electrode during an address period, wherein the width of the scan pulse substantially ranges from 0.6 us to 1.2 us, wherein:

the differential signal includes a first signal and a second signal being an inverted signal of the first signal and wherein a voltage level difference between the first and second signals substantially ranges from 0.1V to 0.5V, a differential signal transmitter transmits a main clock signal, a strobe signal, a high blanking signal, and a low blanking signal to a differential signal receiver, wherein the main clock signal, strobe signal, high blanking signal, and low blanking signal are transmitted in a transistor-transistor logic (TTL) manner, the differential signal receiver transmits the main clock signal, the strobe signal, the high blanking signal, and the low blanking signal to a data drive integrated circuit, the main clock signal is a clock signal for an operation of the data drive integrated circuit and has a frequency of substantially 50 MHz, and the differential signal includes a differential data signal which is subfield mapped and rearranged for an address electrode, and a differential clock signal for controlling the transmission of the differential data signal.

14. The method of claim 13, wherein the differential clock signal substantially has a frequency of 200 MHz.

15. The method of claim 13, wherein the differential clock signal substantially has a frequency of 400 MHz.

* * * * *